US006793014B2

(12) United States Patent
Matsuzaki

(10) Patent No.: US 6,793,014 B2
(45) Date of Patent: Sep. 21, 2004

(54) HEAT TRANSFER MEMBER AND METHOD FOR MANUFACTURING SAME

(75) Inventor: Toyoaki Matsuzaki, Shizuoka-Ken (JP)

(73) Assignee: Xenesys, Inc. (JP)

( * ) Notice: Subject to any disclaimer, the term of this patent is extended or adjusted under 35 U.S.C. 154(b) by 0 days.

(21) Appl. No.: 10/156,501

(22) Filed: May 29, 2002

(65) Prior Publication Data

US 2003/0005583 A1 Jan. 9, 2003

(30) Foreign Application Priority Data

Jun. 22, 2001 (JP) ..... 2001-181124

(51) Int. Cl.[7] ..... B21D 53/04; F28F 3/04

(52) U.S. Cl. ..... 165/166; 165/167; 29/890.03; 29/890.07; 29/33 G; 29/33 Q; 29/430; 29/564; 72/379.2

(58) Field of Search ..... 428/586, 603; 165/666, 166, 167; 29/890.03, 890.07, 430, 564, 33 G, 33 Q; 72/404, 379.2, 379.4, 413, 405.06, 127, 405

(56) References Cited

U.S. PATENT DOCUMENTS 4,227,396 A * 10/1980 Crowe ..... 72/469
4,434,643 A * 3/1984 Almqvist et al. ..... 72/379.6
4,736,610 A 4/1988 Carroll et al.
4,819,473 A 4/1989 Jansen
4,901,815 A * 2/1990 Harwood et al. ..... 181/282
5,168,923 A * 12/1992 Sacks ..... 165/151
5,417,097 A 5/1995 Kojima et al.
5,791,186 A * 8/1998 Nishida et al. ..... 72/337
6,530,255 B1 * 3/2003 Usui et al. ..... 72/334
2002/0078565 A1 * 6/2002 Matsuzaki ..... 29/890.03
2003/0024697 A1 * 2/2003 Matsuzaki ..... 165/166

FOREIGN PATENT DOCUMENTS

JP 2002-035871 * 2/2002

OTHER PUBLICATIONS

EPO Search Report dated Feb. 23, 2004.

* cited by examiner

*Primary Examiner*—John J. Zimmerman
(74) *Attorney, Agent, or Firm*—Rader, Fishman & Grauer PLLC

(57) ABSTRACT

A method for manufacturing a heat transfer member comprises the step of subjecting a material to be worked, which is made of a metallic thin sheet, to a press forming utilizing a press-forming device to form a heat transfer member for a heat exchanger. The heat transfer member has on at least one portion thereof a heat transfer face that has opposite surfaces, which are to be come into contact with heat exchange fluids, respectively. The press-forming device comprises a pair of main molds for forming the heat transfer face on the material, which is to be conveyed in a single feeding direction, and two pairs of first auxiliary molds, which are disposed on upstream and downstream sides of the pair of main molds in the feeding direction of the material, so as to be exchangeable. Portions of the material are subjected to the press forming utilizing at least one pair of the pair of main molds and the two pairs of first auxiliary molds to form the heat transfer member having press-formed portions in a prescribed pattern.

9 Claims, 12 Drawing Sheets

HEAT TRANSFER MEMBER AND METHOD FOR MANUFACTURING SAME

BACKGROUND OF THE INVENTION

1. Field of the Invention

The present invention relates a method for press-forming a material to be worked to form a heat transfer member for a heat exchanger, on the one hand, and the heat transfer member manufactured by the above-mentioned method, on the other hand, and especially to a method for applying a press-forming step to the material to be worked utilizing a plurality of molds so as to form a plurality of press formed portions arranged in a prescribed pattern, on the one hand, and the heat transfer member having such press formed portions, on the other hand.

2. Description of the Related Art

The heat transfer member of the heat exchanger, which is generally formed of a metallic sheet, is press-formed into a prescribed shape and then welded as an occasion demands, thus providing a finished product, which is to be put into practice. With respect to manufacture of the heat transfer member with the use of the press-forming device, a set of metallic molds have conventionally been used. More specifically, the material to be worked is held between the molds. Motion of moving the molds closely to each other has formed a pattern of irregularities serving as the heat transfer face on the metallic thin sheet of the material to be worked. The heat transfer face has the opposite surfaces, which are to be come into contact with heat exchange fluids, respectively.

The heat transfer member has conventionally been formed in the manner as described above. Formation of the entirety of the heat transfer member is carried out with the use of a single set of molds, thus making it impossible to manufacture the heat transfer member having a larger size than that of the molds. Thus, the size of the molds restricts the size of the heat transfer member. Accordingly, restriction in size of the molds makes it hard to manufacture the heat transfer member having a large area, thus causing a problem.

SUMMARY OF THE INVENTION

An object of the present invention, which was made to solve the above-mentioned problems, is therefore to provide a method for manufacturing a heat transfer member, which permits to easily manufacture the heat transfer member having a larger size than molds of a press-forming device, by incorporating the molds into the press-forming device so as to be selectively applicable, and making an appropriate selection of the molds in view of the size of the material to be worked to carry out a press-forming step so that placement of a plurality of press-formed portions in a prescribed pattern copes with the whole shape of the heat transfer member to be manufactured, thus appropriately providing the elongated material to be worked with a pattern of irregularity, to perform an easy manufacture of the heat transfer member having the large size than those of the molds.

In order to attain the aforementioned object, a method of the first aspect of the present invention for manufacturing a heat transfer member comprises the step of:

subjecting a material to be worked, which is made of a metallic thin sheet, to a press forming utilizing a press-forming device to form a heat transfer member for a heat exchanger, said heat transfer member having a prescribed shape, said heat transfer member having on at least one portion thereof a heat transfer face that has opposite surfaces, which are to be come into contact with heat exchange fluids, respectively, wherein:

said press-forming device comprises a pair of main molds for forming the heat transfer face on a prescribed portion of the material to be worked, which is to be conveyed in a single feeding direction, and two pairs of first auxiliary molds, which are disposed on upstream and downstream sides of the pair of main molds in the feeding direction of the material to be worked, so as to be exchangeable; and a plurality of portions of the material to be worked is subjected to the press forming utilizing at least one pair of said pair of main molds and said two pairs of first auxiliary molds to form the heat transfer member having a plurality of press-formed portions in a prescribed pattern.

According to the features of the first aspect of the present invention, the press forming is applied to the material to be worked with the use of the pair of main molds and the two pairs of first auxiliary molds, which are disposed in the feeding direction of the material to be worked. The plurality of different press-formed portions is formed on the material to be worked in the prescribed pattern so as to perform formation of the heat transfer member. The press-formed portions are further formed on prescribed regions of the heat transfer member. It is therefore possible to appropriately form a prescribed pattern of irregularity or prescribed flat portions on the outer peripheral portion of the material to be worked, independently from the heat transfer face, thus providing desired functions. The thus manufactured heat transfer member can cope with different conditions of use. In addition, the press-forming steps can be applied together to the material to be worked, utilizing the plurality of molds, thus improving the efficiency of the press forming. Even when the material to be worked is elongated and long, the appropriate press-forming steps can be carried out to form the heat transfer faces and the other portions over the entire length. As a result, it is possible to form the heat transfer face having a larger size than that of the molds in a reliable manner, thus permitting increase in size per unit of the heat transfer member so as to manufacture the heat exchanger having the enhanced heat exchange effectiveness.

In the second aspect of the present invention, as an occasion demands, said press forming device may carry out at least one of operations of (i) applying simultaneously the press forming to the material to be worked within a prescribed area starting from one end thereof, with a use of said pair of main molds and one of said two pairs of first auxiliary molds, while keeping an other of said two pairs of first auxiliary molds in a non-contacting state with the material to be worked, and (ii) applying simultaneously the press forming to the material to be worked within a prescribed area starting from an other end thereof, with a use of said pair of main molds and said other of said two pairs of first auxiliary molds, while keeping said one of said two pairs of first auxiliary molds in a non-contacting state with the material to be worked.

According to the features of the second aspect of the present invention, the press-forming step can be applied simultaneously to the prescribed area starting from the one end of the material to be worked, with the use of combination of the pair of main molds and one of the two pairs of the first auxiliary molds or the combination of the pair of main molds and the other of the two pairs thereof, while keeping the remaining one of the two pairs of the first auxiliary molds in the non-contacting state with the material to be worked. The heat transfer face and the remaining press-formed portions can be formed simultaneously on the material to be worked, so as to be arranged in the prescribed pattern. It is therefore possible to form efficiently a plurality of the press-formed portions on the material to be worked at the minimum number of press-forming steps, thus remarkably improving the press-forming efficiency. When the press-forming step is carried out utilizing a certain pair of molds, the remaining pairs of molds are kept in the non-contacting state with the material to be worked, thus ensuring a desired shape of the heat transfer member.

In the third aspect of the present invention, as an occasion demands, there may be adopted a structure in which said press forming device further comprises two pairs of second auxiliary molds, which are disposed on opposite sides of said pair of main mold in a perpendicular direction to said feeding direction, so as to be exchangeable, each of said two pairs of second auxiliary molds being kept in any one of a state in which a press-forming operation utilizing the pair of second auxiliary molds is carried out in synchronization with a press-forming operation utilizing the pair of main molds and an other state in which the pair of second auxiliary molds is kept in a non-contacting state with the material to be worked; and the heat transfer member is formed so that a press-formed portion formed by means of the pair of second auxiliary molds and the heat transfer face are arranged in at least one area.

According to the features of the third aspect of the present invention, the press forming is applied to the material to be worked, utilizing the pair of main molds and the pairs of second auxiliary molds, which are disposed in the perpendicular direction to the feeding direction, as an occasion demands, so that the prescribed press-formed portion is formed side by side with the heat transfer face on the material to be worked, with the use of the pair of second auxiliary molds, thus providing the prescribed press-formed portions on the respective edges of the material to be worked. It is therefore possible to achieve an appropriate formation of the prescribed press-formed portions on the respective edges of the material to be worked, independently from the heat transfer face, so as to impart the prescribed functions to the respective portions of the heat transfer member, thus providing the heat transfer member coping appropriately with the various conditions of use. When the press-forming step utilizing the pair of second auxiliary molds is not required, the pair of them is kept in the non-contacting state with the material to be worked, thus ensuring a desired shape of the heat transfer member.

In order to attain the aforementioned object, a heat transfer member for a heat exchanger, of the fourth aspect of the present invention, is obtained by subjecting a material to be worked, which is made of a metallic thin sheet, to a press forming utilizing a press-forming device, said heat transfer member having a prescribed shape, and said heat transfer member having on at least one portion thereof a heat transfer face that has opposite surfaces, which are to be come into contact with heat exchange fluids, respectively, wherein:

said heat transfer member is formed by inserting the material to be worked into the press-forming device, which includes a pair of main molds for forming the heat transfer face and a plurality pairs of auxiliary molds adjacent to a periphery of said pair of main molds, transferring the material to be worked in a single feeding direction, subjecting the material to be worked to a press forming utilizing the pair of main molds to form the heat transfer face at a central portion of the material to be worked and forming at least one flange portion having a prescribed shape on a periphery of the transfer face with a use of the plurality of pairs of auxiliary molds so that a plurality of press-formed portions are arranged in a prescribed pattern.

According to the features of the fourth aspect of the present invention, the material to be worked, which is made of a metallic thin sheet, is press-formed utilizing the pair of main molds and the pair s of auxiliary molds of the press-forming device so as to form the different press-formed portions in a prescribed pattern so that the respective portions of the material to be worked are formed into the heat transfer face and the flange portion. Especially, the peripheral portions of the heat transfer member have the suitable shapes serving as the flange portion, which provide the different functions from those of the heat transfer face, thus coping with the various conditions of use. Even when the material to be worked is elongated and long, the appropriate press-forming steps can be carried out to form the heat transfer faces and the flange portion over the entire length. As a result, it is possible to form the heat transfer face having a larger size than that of the molds in a reliable manner, thus permitting increase in size per unit of the heat transfer member so as to manufacture the heat exchanger having the enhanced heat exchange effectiveness.

In the fifth aspect of the present invention, as an occasion demands, there may be adopted a structure in which said flange portion comprises a plurality of flat portions having a prescribed width, which are formed continuously on a periphery of the heat transfer face; and at least one recess or projection is formed so as to extend from an outer edge over said flat portion to lead to the heat transfer face.

According to the features of the fifth aspect of the present invention, the heat transfer member is provided with the flat portions, which are disposed continuously in the peripheral direction of the heat transfer member so as to serve as the flange portion, and with the recess or projection. When the heat transfer member is placed on the other heat transfer member so that the inner surfaces of them face each other, the flat portions of the former come into contact with the flat portions of the latter to form an internal cavity, which is surrounded by the flange portions and the respective heat transfer faces. The recesses or projections of these heat transfer members form a passage, which communicates with the internal cavity. As a result, positional determination of the recesses or projections of the heat transfer members makes it possible to form the passage through which heat exchange fluid flows in the assembled heat exchanger unit. In addition, it is possible to provide various kinds of flow of the heat exchange fluid, such as a cross-flow type, in the entirety of the heat exchanger. In case where the heat transfer members, which have been press-formed, are finally welded together to form an assembled heat exchanger unit, the flat portions serve as the portion to be welded, thus facilitating the welding operation.

In the sixth aspect of the present invention, as an occasion demands, there may be adopted a structure in which the material to be worked is formed of the metallic thin sheet having a rectangular shape; and said flange portion is formed on each of at least a pair of opposite sides of the periphery of the heat transfer face, said flange portion on one of the pair of opposite sides being provided with grooved portions, which are formed continuously in a direction parallel to the opposite sides so as to provide a smooth wave-shape cross section, and said flange portion on an other of the pair of opposite sides being provided with projection portions, which are formed continuously in a direction parallel to the opposite sides so as to provide a smooth wave-shape cross section.

According to the features of the sixth aspect of the present invention, the opposing portions of the flange portion are provided at the prescribed position with the smooth wave-shaped cross section to form rows of irregularity, in which the recesses or projections continue in parallel with the opposing portions of the flange portion. Such a structure imparts a sufficient strength against the bending stress that is applied to the flange portion having the recesses or projections, thus enhancing the strength of the flange portion. Accordingly, it is possible to surely keep the entirety of the heat transfer member in a proper shape. It is also possible to hold the flange portion of the heat transfer member to transfer it during manufacturing steps, preventing the heat transfer member from being deformed and insuring accuracy in shape. Formation of irregularity having the wave-shaped cross section improves formability of the flange portion, thus reducing rate of occurrence of defects in products.

In the seventh aspect of the present invention, as an occasion demands, there may be adopted a structure in which the material to be worked is formed of the metallic thin sheet having a rectangular shape; and each of at least a pair of opposite sides of said flange portion is provided with any one of at least one recess and at least one projection in at least one of a central position in an area, which is subjected to a single press-forming step utilizing said auxiliary molds, on one hand, and symmetrical positions with respect to said central position, on an other hand, said at least one recess and said at least one projection facing in a same direction.

According to the features of the seventh aspect of the present invention, the flange portion has any one of the at least one recess and the at least one projection in at least one of central position between an area of the material to be worked, which is subjected to the single press-forming step utilizing the auxiliary molds and symmetrical positions with respect to the central position. The above-mentioned any one of the at least one recess and the at least one projection formed on one of the pair of opposite sides of the periphery of the material to be worked faces in the same direction as the other of them formed on the other of the pair of opposite sides thereof. When the heat transfer member is placed on the other heat transfer member so that the inner surfaces of them face each other and the latter is positioned upside down, the recess or projections of the former face those of the latter and the remaining portions of the flange portion come into close contact with each other. When the assembled heat exchanger unit is placed on the other assembled heat exchanger unit, the recess or projection of the former heat exchanger unit comes into contact with that of the latter heat exchanger unit. Accordingly, the recess or projection serves as a spacer for providing a space between the two adjacent heat exchanger units, thus maintaining a constant distance between the heat transfer faces, providing a uniform heat exchanging property and increasing strength of the heat exchanger. In addition, the recesses or projections face each other to form at least one passage on the side of the flange portion. The heat transfer member can be held at its passage portion to transfer it, thus making it possible to hold the transfer member in a proper manner and providing a safe transporting operation of the heat transfer member.

In the eighth aspect of the present invention, as an occasion demands, there may be adopted a structure in which the material to be worked is formed of the metallic thin sheet having a rectangular shape; and each of at least a pair of opposite sides of said flange portion is provided with any one of at least one recess and at least one projection in at least one of a central position in an area, which is subjected to a single press-forming step utilizing said auxiliary molds, on one hand, and symmetrical positions with respect to said central position, on an other hand, said at least one recess and said at least one projection facing in an opposite direction to each other.

According to the features of the eighth aspect of the present invention, the flange portion has any one of the at least one recess and the at least one projection in at least one of a central position in an area of the material to be worked, which is subjected to the single press-forming step utilizing the auxiliary molds and symmetrical positions with respect to the central position. The above-mentioned any one of the at least one recess and the at least one projection formed on one of the pair of opposite sides of the periphery of the heat transfer face faces in the opposite direction to the other of them formed on the other of the pair of opposite sides thereof. When the heat transfer member is placed on the other heat transfer member so that the inner surfaces of them face each other and the latter is positioned upside down, the projection of the former heat transfer member is received into the recess of the latter heat transfer member to prevent deviation of these members. In addition, the remaining portions of the flange portion come into close contact with each other so that the recess or projection serves as a guide member by which positional determination for placing the heat transfer members one upon another. It is therefore possible to make a rapid positional determination when the heat transfer members are placed one upon another during manufacture of the heat exchanger unit. The heat transfer member, which has been placed on the other heat transfer member, may not deviate from the latter during a transporting operation of them, thus enhancing working precision in the subsequent step.

In the ninth aspect of the present invention, as an occasion demands, there may be adopted a structure in which the material to be worked is formed of the metallic thin sheet having a rectangular shape; and said flange portion has any one of a shoulder portion having a prescribed width and an inclined portion, which extends from a peripheral edge by a prescribed length and is inclined from a remaining portion by a prescribed angle.

According to the features of the ninth aspect of the present invention, the flange portion formed in any one of the periphery of the material to be worked has any one of the shoulder portion having the prescribed width and the inclined portion, which extends from the peripheral edge by the prescribed length and is inclined from the remaining portion by the prescribed angle. When the heat transfer member is placed on the other heat transfer member so that the inner surfaces of them face each other and the shoulder portions or inclined portions face each other, a trough-shaped portion is formed on the flange portion. In addition, the remaining portions of the flange portion come into close contact with each other. It is therefore possible to direct the trough-shaped portion upward so as to serve as a receiving member for receiving the heat exchange fluid. As a result, there can be set appropriately a flow path for the heat exchange fluid in the heat exchanger unit into which the heat transfer members are assembled. Heat exchange conditions on the outer surface of the heat exchanger unit can be set in view of the use of the heat exchanger, thus coping with the various type of use.

DETAILED DESCRIPTION OF THE PREFERRED EMBODIMENTS

[First Embodiment of the Present Invention]

Figure 1:
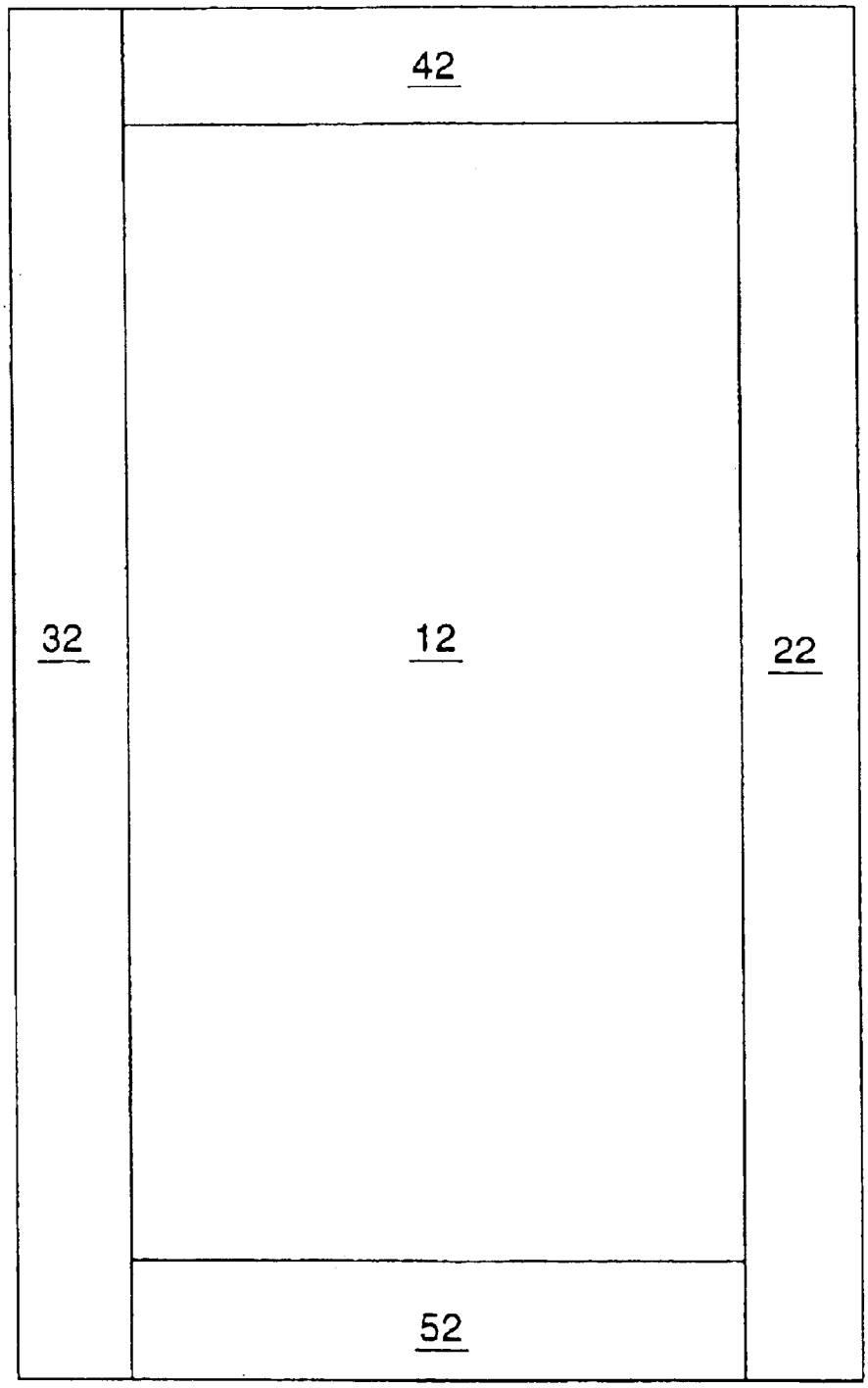
FIG. 1 is a plan view illustrating arrangement of molds of a press-forming device, which is used in a method of the first embodiment of the present invention for manufacturing a heat transfer member.
Figure 2A:
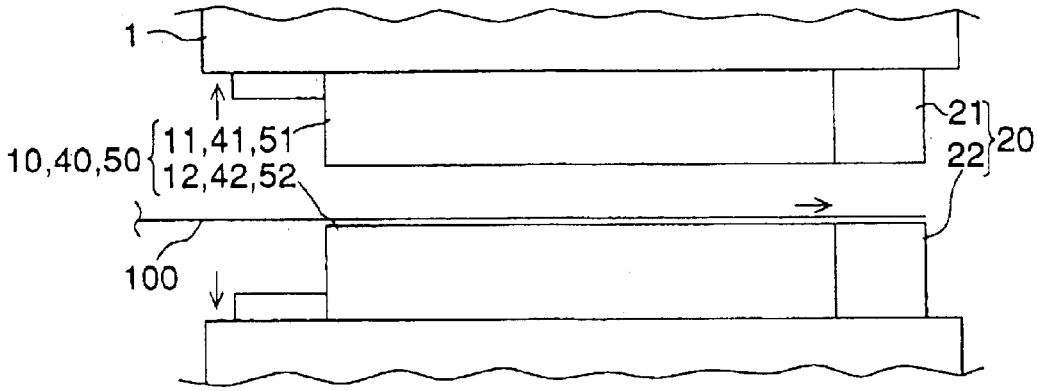
FIG. 2, consisting of FIGS. 2A, 2B, 2C, is a descriptive view illustrating a press-forming operation carried out on the one end portion of the material to be worked, in accordance with the method of the first embodiment of the present invention for manufacturing the heat transfer member.
Figure 2B:
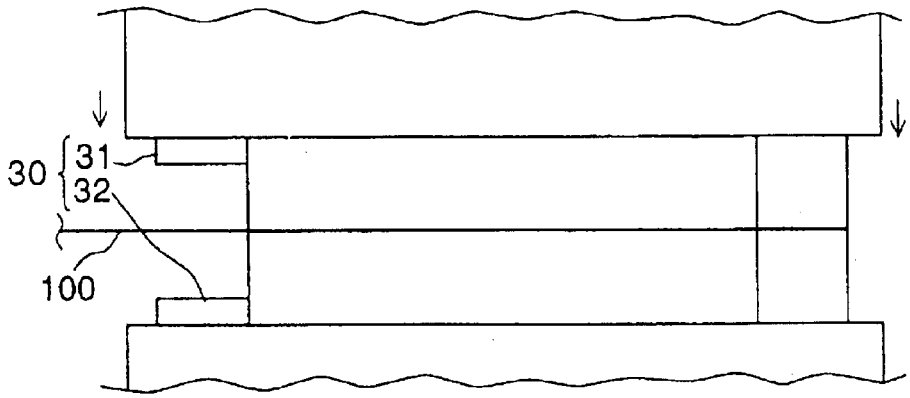
Figure 2C:
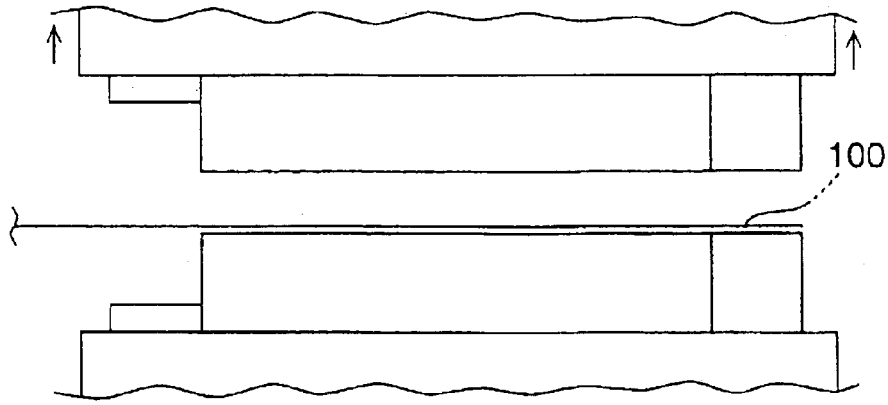
Figure 3A:
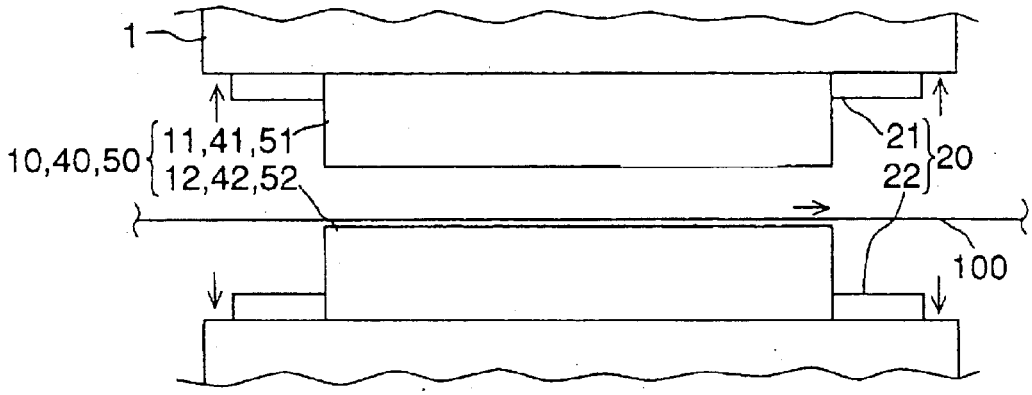
FIG. 3, consisting of FIGS. 3A, 3B, and 3C, is a descriptive view illustrating a press-forming operation carried out on the intermediate portion of the material to be worked, in accordance with the method of the first embodiment of the present invention for manufacturing the heat transfer member.
Figure 3B:
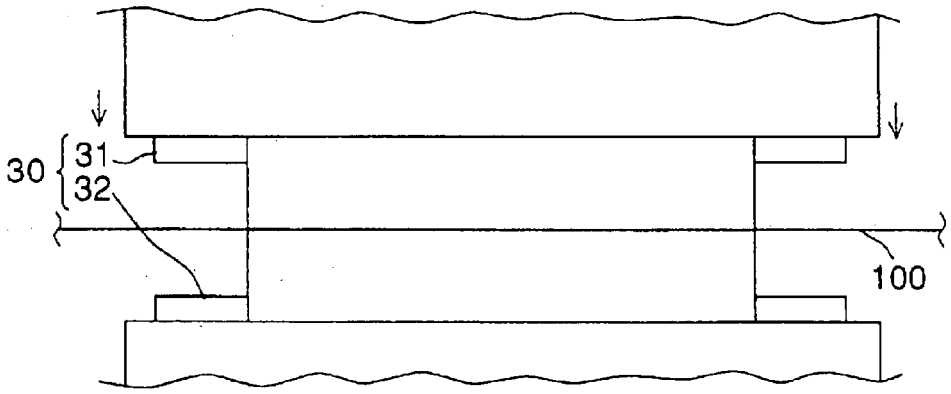

Now, the first embodiment of the present invention will be described in detail below with reference to FIGS. 1 to 4. FIG. 1 is a plan view illustrating arrangement of molds of a press-forming device, which is used in a method of the first embodiment of the present invention for manufacturing a heat transfer member, FIG. 2 is a descriptive view illustrating a press-forming operation carried out on the one end portion of the material to be worked, in accordance with the method of the first embodiment of the present invention for manufacturing the heat transfer member, FIG. 3 is a descriptive view illustrating a press-forming operation carried out on the intermediate portion of the material to be worked, in accordance with the method of the first embodiment of the present invention for manufacturing the heat transfer member and FIG. 4 is a descriptive view illustrating a press-forming operation carried out on the other end portion of the material to be worked, in accordance with the method of the first embodiment of the present invention for manufacturing the heat transfer member.

The method of the first embodiment of the present invention as shown in FIGS. 1 to 4 comprises the steps of subjecting the end portions of the material to be worked 100, which is made of an elongated metallic thin sheet, to a press forming utilizing two pairs of first auxiliary molds 20, 30 disposed on the opposite sides, of a plurality of molds of a press-forming device 1, and subjecting the material to be worked 100, which is conveyed by a prescribed length in the longitudinal direction thereof, to a press forming utilizing a pair of main molds 10 and pairs of second auxiliary molds 40, 50, which are disposed between the above-mentioned two pairs of first auxiliary molds 20 and 30, by a plurality of times at prescribed intervals in the longitudinal direction of the material to be worked 100, so that the prescribed press-formed portions are formed on the material to be worked 100 so as to be arranged in a prescribed pattern in the longitudinal direction thereof, thereby preparing a heat transfer member for a heat exchanger.

The press-forming device 1 used in the method of the first embodiment of the present invention for manufacturing the heat transfer member includes the pair of main molds 10, the two pairs of first auxiliary molds 20, 30 and the two pairs of second auxiliary molds 40, 50. The pair of main molds 10 forms the heat transfer face having the opposite surfaces, which are to be come into contact with heat exchange fluids, respectively. The pairs of first auxiliary molds 20, 30 are disposed in the vicinity of the pair of main molds 10 on the upstream and downstream sides thereof in the feeding direction of the material to be worked 100, so as to be exchangeable. The pairs of second auxiliary molds 40, 50 are disposed in the vicinity of the pair of main molds 10 on the opposite sides thereof in the perpendicular direction to the feeding direction of the material to be worked 100, so as to be exchangeable.

The pair of molds 10, 20, 30, 40 and 50 is composed of upper molds 11, 21, 31, 41 and 51 and lower molds 12, 22, 32, 42 and 52, respectively. The upper molds 11, 21, 31, 41 and 51, which have molding surfaces for providing press-formed portions on one surface of the heat transfer member, respectively, are movable up and down within a prescribed range so that the above-mentioned molding surfaces face downward. The lower molds 12, 22, 32, 42 and 52, which have molding surfaces for providing press-formed portions on the other surface of the heat transfer member, respectively, are disposed to face the upper molds 11, 21, 31, 41 and 51, respectively so that the above-mentioned molding surfaces face upward.

A mark detection device (not shown) for judging whether or not a prescribed portion to be press-formed of the material to be worked 100 reaches the respective press-forming position is provided in the vicinity of each of the pair of main molds 10, the pairs of first auxiliary molds 20, 30 and the pairs of second auxiliary molds 40, 50.

A marking device (not shown) for putting prescribed marks (not shown) on the surface of the material to be worked 100, which define positions of the material to be worked 100 to which the press forming is to be applied, is disposed in the upstream side of the press-forming device 1 in the feeding direction of the material to be worked 100. Detection of the marks on the material to be worked 100, which is conveyed in the prescribed single direction, utilizing the mark detection device causes the respective molds to operate so that the press forming is applied to the prescribed position of the material to be worked 100, on which the mark have been put.

Now, description will be given below of press-forming operation, which is carried out in accordance with the method of the first embodiment of the present invention for manufacturing the heat transfer member. Such an operation is carried out on the assumption that a defect detection step is carried out immediately after the material to be worked 100 is uncoiled from a coil (not shown) and only in case where no defects are detected, the marks for the press-forming positions are put on the prescribed positions of the surface of the material to be worked 100 and the material to be worked 100 is then conveyed to the side of the press forming device 1.

The press forming is carried out with the use of the pair of first auxiliary molds 20, the pair of main molds 10 and the pairs of second auxiliary molds 40, 50 of the plurality of pairs of molds of the press-forming device 1. The pair of first auxiliary molds 20 is disposed on the forefront side in the feeding direction of the material to be worked. The pair of main molds 10 and the pairs of second auxiliary molds 40, 50 are disposed on the middle side. The pair of main molds 10, the pair of first auxiliary molds 20 and the pairs of second auxiliary molds 40, 50 are previously kept in their initial state in which the respective upper and lower molds are separated from each other. The upper mold 31 of the other pair of first auxiliary molds 30 is kept in the higher position than the upper molds 11, 21, 41 and 51, on the one hand, and the lower mold 32 thereof is kept in the lower position than the lower molds 12, 22, 42 and 52, on the other hand. The material to be worked 100 is conveyed by means of a material feeding unit (not shown) so that one end of the material to be worked 100 is inserted between the respective upper and lower molds (see FIG. 2(A)). The mark detection operation is carried out utilizing the mark detection device when the material to be worked 100 is inserted between the upper and lower molds by means of the material feeding unit.

When the one end of the material to be worked 100 reach the prescribed position between the molds of the press-forming device 1 and the mark detection device detects the forefront mark of the material to be worked 100, the feeding operation of the material to be worked 100 is temporarily stopped. The press-forming device 1 operates to move all the upper molds together toward the lower molds so that the material to be worked 100 is press-formed with the use of the upper molds 11, 21, 41, 51 and the lower molds 12, 22, 42, 52 (see FIG. 2(B)). The pair of main molds 10, the pair of first auxiliary molds 20 and the pairs of second auxiliary molds 40, 50 of the press-forming device 1 press the one end of the material to be worked 100 so that the uniform pressure is applied to the material to be worked 100 to form press-formed portions having a prescribed irregularity in accordance with the respective molds in a reliable manner. At this stage, the pair of first auxiliary molds 30 is kept in a relatively remote position from the material to be worked 100 in comparison with the other pair of molds, thus preventing the pair of first auxiliary molds 30 from coming into contact with the material to be worked 100.

After completion of the press-forming step applied to the one end of the material to be worked 100, the press-forming device 1 operates to separate all the pairs of upper and lower molds from each other. The feeding operation of the material to be worked 100 is carried out again by means of the material feeding unit (see FIG. 2(C)).

Then, only the pair of main molds 10 and the pairs of second auxiliary molds 40, 50, which are disposed on the middle side in the feeding direction of the material to be worked, operate to carry out the press-forming operation. The pair of main molds 10 and the pairs of second auxiliary molds 40, 50 are previously kept in their initial state in which the respective upper and lower molds are separated from each other. Then, the upper molds 21, 31 of the pairs of first auxiliary molds 20, 30 are kept in the higher position than the upper molds 11, 41, 51, on the one hand, and the lower molds 22, 32 thereof are kept in the lower position than the lower molds 12, 42, 52, on the other hand. The material to be worked 100 is conveyed by means of the material feeding unit so that a portion following the one end of the material to be worked 100 is inserted between the respective upper and lower molds (see FIG. 3(A)).

The mark detection operation is also carried out utilizing the mark detection device when carrying out the press-forming operation with the use of the pair of main molds 10 and the pairs of second auxiliary molds 40, 50. When the portion following the one end of the material to be worked 100 moves to the respective spaces between the upper and lower molds and the mark detection device detects the second mark of the material to be worked 100, the feeding operation of the material to be worked 100 is temporarily stopped. The press-forming device 1 operates to move all the upper molds together toward the lower molds so that the material to be worked 100 is press-formed with the use of the upper molds 11, 41, 51 and the lower molds 12, 42, 52 (see FIG. 3(B)). The pair of main molds 10 and the pairs of second auxiliary molds 40, 50 press the adjacent portion to the one end of the material to be worked 100 in the same manner as described above so that the uniform pressure is applied to the material to be worked 100 to form press-formed portions having a prescribed irregularity in accordance with the respective molds in a reliable manner. At this stage, the pairs of first auxiliary molds 20, 30 are kept in a relatively remote position from the material to be worked 100 in comparison with the other pair of molds, thus preventing the pairs of first auxiliary molds 20, 30 from coming into contact with the material to be worked 100.

Figure 3C:
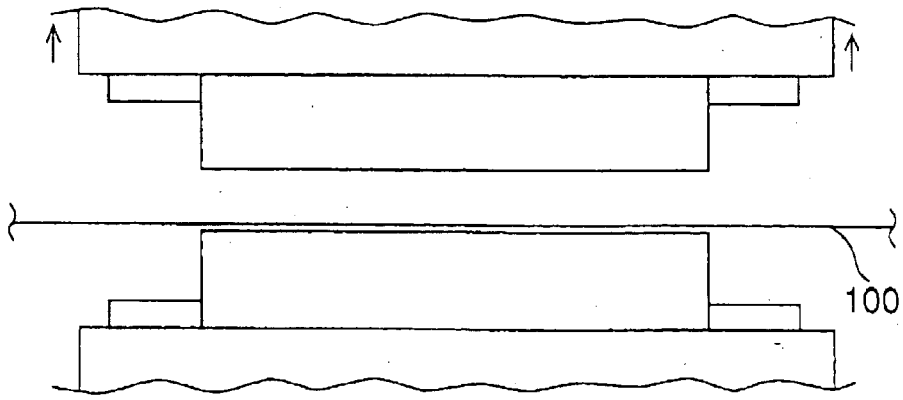
Figure 4A:
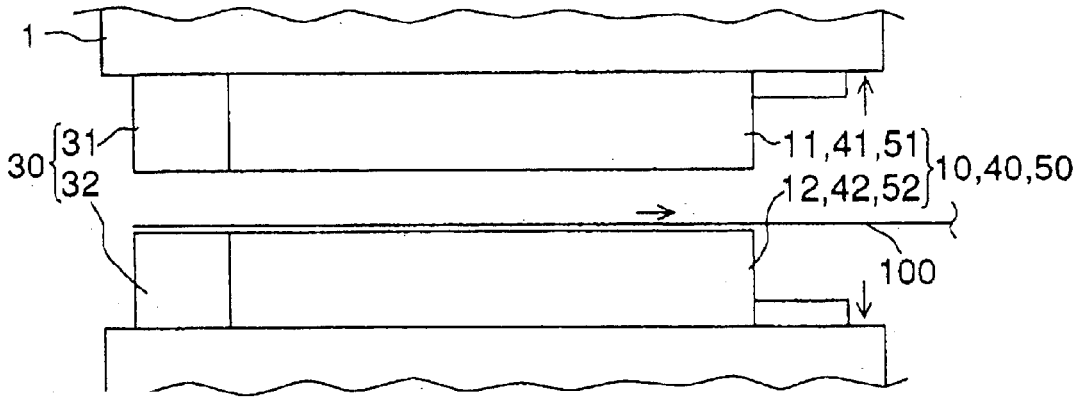
FIG. 4, consisting of FIGS. 4A, 4B, and 4C, is a descriptive view illustrating a press-forming operation carried out on the other end portion of the material to be worked, in accordance with the method of the first embodiment of the present invention for manufacturing the heat transfer member.
Figure 4B:
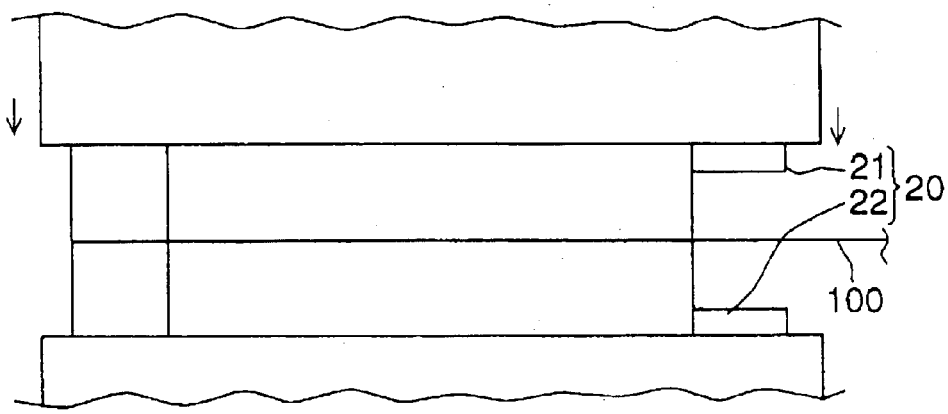

After completion of the press-forming step, the press-forming device 1 operates to separate all the pairs of upper and lower molds from each other (see FIG. 3(C)). The feeding operation of the material to be worked 100 is carried out again by means of the material feeding unit. The material to be worked 100 is conveyed until the next mark is detected. After detection of the mark 140 utilizing the mark detection device, the press-forming device 1 operates to move the upper and lower molds closely to each other so that the other portion of the material to be worked 100 is press-formed.

Then, a series of steps for transferring the material to be worked 100, detecting the marks and applying the press forming is repeated by a time of numbers of the marks excepting the marks, which are put on the opposite end portions of the material to be worked 100. Accordingly, a plurality of press-forming steps are applied to the material to be worked 100, which is conveyed by a prescribed length for each of the press-forming steps, utilizing the pair of main molds 10 and the pairs of second auxiliary molds 40, 50 of the press-forming device 1 to which the press-forming instructions have been given based on the mark, so that the press-formed portions are formed at prescribed intervals on the material to be worked 100. As a result, the press-formed portions formed by means of the pair of main molds 10 and the pairs of second auxiliary molds 40, 50 are arranged in the prescribed pattern on the material to be worked 100 in the longitudinal direction thereof.

After the prescribed number of press-forming steps is completed with the use of the pair of main molds 10 and the pairs of second auxiliary molds 40, 50 of the press-forming device 1, a further press-forming step is carried out with the use of the pair of first auxiliary molds 30, which is disposed on the rearmost side in the feeding direction of the material to be worked 100, as well as the pair of main molds 10 and the pairs of second auxiliary molds 40, 50, which are disposed on the middle side in the feeding direction thereof. The pair of main molds 10, the pair of first auxiliary molds 30 and the pairs of second auxiliary molds 40, 50 are previously kept in their initial state in which the respective upper and lower molds are separated from each other. The upper mold 21 of the other pair of first auxiliary molds 20 is kept in the higher position than the upper molds 11, 31, 41 and 51, on the one hand, and the lower mold 22 thereof is kept in the lower position than the lower molds 12, 32, 42 and 52, on the other hand. The material to be worked 100 is conveyed by means of the material feeding unit so that the other end portion of the material to be worked 100 is inserted between the respective upper and lower molds (see FIG. 4(A)).

The mark detection operation is also carried out utilizing the mark detection device when carrying out the press-forming operation with the use of the pair of main molds 10, the pair of first auxiliary molds 30 and the pairs of second auxiliary molds 40, 50. When the other end portion of the material to be worked 100 moves to the respective spaces between the upper and lower molds and the mark detection device detects the rearmost mark of the material to be worked 100, the feeding operation of the material to be worked 100 is temporarily stopped. The press-forming device 1 operates to move all the upper molds together toward the lower molds so that the material to be worked 100 is press-formed with the use of the upper molds 11, 31, 41, 51 and the lower molds 12, 32, 42, 52 (see FIG. 4(B)). The pair of main molds 10, the pair of first auxiliary molds 30 and the pairs of second auxiliary molds 40, 50 press the other end portion of the material to be worked 100 in the same manner as described above so that the uniform pressure is applied to the material to be worked 100 to form press-formed portions having a prescribed irregularity in accordance with the respective molds in a reliable manner. At this stage, the pair of first auxiliary molds 20 is kept in a relatively remote position from the material to be worked 100 in comparison with the other pair of molds, thus preventing the pair of first auxiliary molds 20 from coming into contact with the material to be worked 100.

Figure 4C:
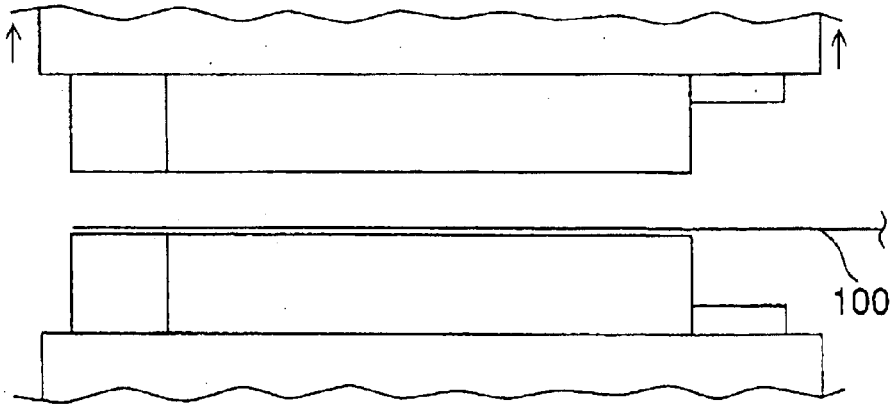

After completion of the press-forming step utilizing the pair of main molds 10, the pair of first auxiliary molds 30 and the pairs of second auxiliary molds 40, 50, the press-forming device 1 operates to separate all the pairs of upper and lower molds from each other (see FIG. 4(C)). The feeding operation of the material to be worked 100 is carried out again by means of the material feeding unit. The material to be worked 100 is conveyed in the feeding direction and then discharged from the upper and lower molds of the press-forming device 1. The material to be worked 100 thus press-formed is then conveyed as a heat transfer member 200 to a place in which the next steps are to be carried out.

According to the method of the first embodiment of the present invention for manufacturing the heat transfer member, a plurality of press-forming steps is carried out with the use of the respective molds of the press-forming device 1, while changing the press-forming position so that a plurality of different press-formed portions are arranged in the prescribed pattern on the material to be worked 100, thus preparing the heat transfer member 200 having the press-formed portions on the respective areas. It is therefore possible to manufacture the heat transfer member 200, which copes with the various conditions of use. Even when the material to be worked 100 is elongated and long, the appropriate press-forming steps can be carried out over the entire length of the material to be worked 100 to form the heat transfer faces 110 having a larger size than that of the molds. There can therefore be manufactured a heat exchanger provided with the heat transfer member 200, which has the increased size per unit of the heat transfer member 200 to enhance the heat exchange effectiveness. A combination of the pair of main molds 10, the pair of first auxiliary molds 20 and the pairs of second auxiliary molds 40, 50 as well as a combination of the pair of main molds 10, the pair of first auxiliary molds 30 and the pairs of second auxiliary molds 40, 50 can operate simultaneously to carry out the press-forming steps, while keeping the remaining pair of first auxiliary molds in a non-contacting state with the material to be worked 100, so that the heat transfer faces 110 and the press-formed portions formed by the respective auxiliary molds can be formed in the prescribed pattern at a time. It is therefore possible to form efficiently a plurality of the press-formed portions on the material to be worked 100 at the minimum number of press-forming steps, thus remarkably improving the press-forming efficiency. When the press-forming step is carried out utilizing a certain pair of molds, the remaining pairs of molds are kept in the non-contacting state with the material to be worked 100, thus ensuring a desired shape of the heat transfer member 200.

In the method of above-described first embodiment of the present invention for manufacturing the heat transfer member, the pair of main molds 10 and the pairs of second auxiliary molds 40, 50 are always used when carrying out the respective press-forming step. The present invention is not limited to such an embodiment and it may be adopted a system in which the previously determined portion of the material to be worked 100 is subjected to the press forming, while keeping the pairs of second auxiliary molds 40, 50 in a remote position from the material to be worked 100, like the pair of first auxiliary molds so that no press forming utilizing the pairs of second auxiliary molds 40, 50 is carried out. The press-forming surfaces of the pairs of first auxiliary molds 20, 30 and the pairs of second auxiliary molds 40, 50 can be exchanged with the other press-forming surfaces so as to cope with use of the heat transfer member 200.

[Second Embodiment of the Present Invention]

Figure 5:
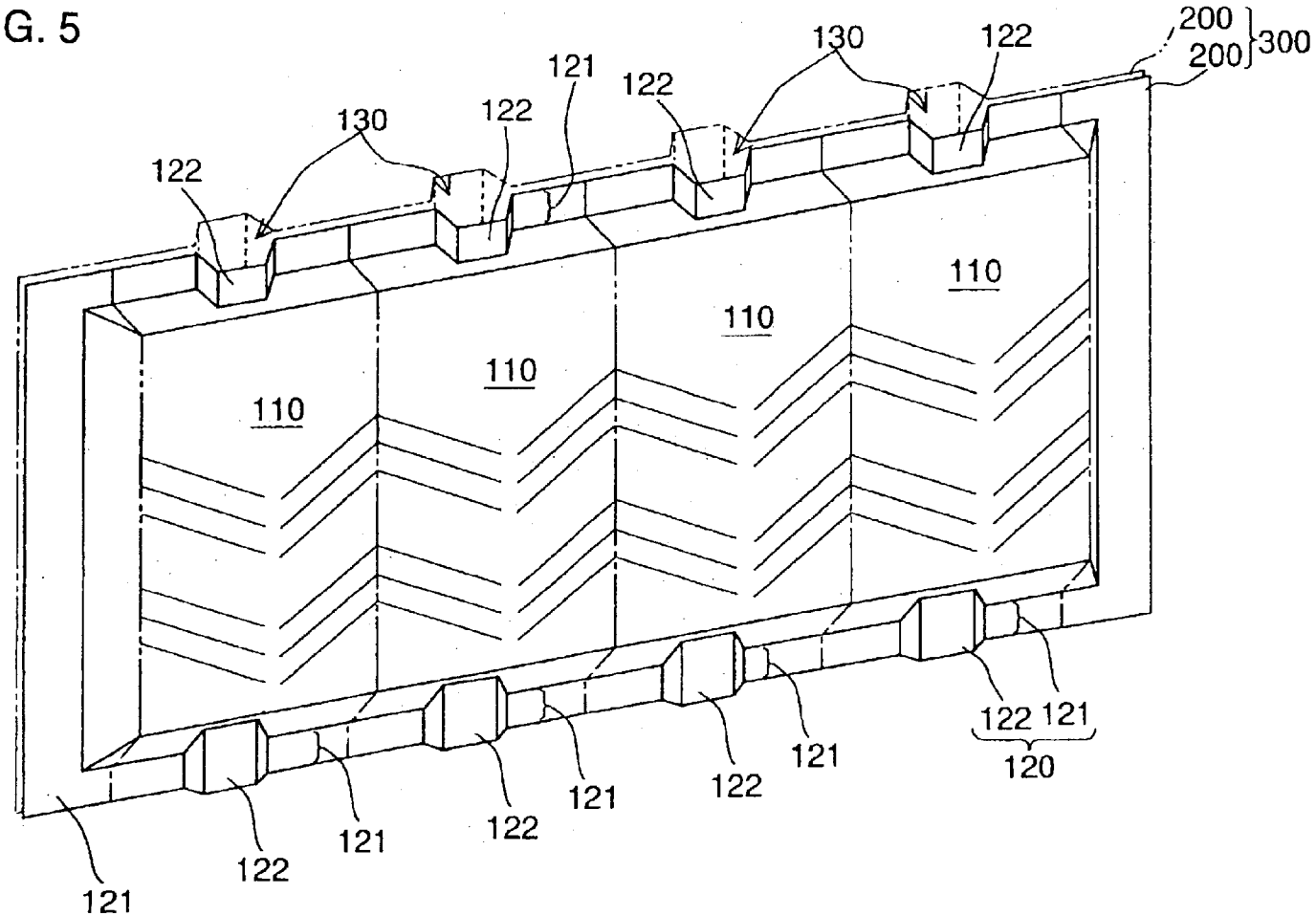
FIG. 5 is a schematic perspective view of the heat transfer member of the second embodiment of the present invention.

Now, the second embodiment of the present invention will be described in detail below with reference to FIG. 5. With respect to the second embodiment of the present invention, there is described the heat transfer member, which is manufactured in accordance with the method of the present invention for manufacturing the heat transfer member. FIG. 5 is a schematic perspective view of the heat transfer member of the second embodiment of the present invention.

The heat transfer member 200 of the second embodiment of the present invention is obtained by subjecting the material to be worked, which is made of a rectangular metallic thin sheet, to a press forming utilizing a press-forming device 1. The heat transfer member 200 is formed by inserting the material to be worked into the press-forming device 1, transferring the material to be worked in the single feeding direction, subjecting the material to be worked to the press forming utilizing the pair of main molds 10 of the press-forming device 1 to form the heat transfer face 110 at a central portion of the material to be worked and the flange portion 120 on the periphery of the heat transfer face 110 with the use of the pairs of first auxiliary molds 20, 30 and the pairs of second auxiliary molds 40, 50 so that the plurality of press-formed portions are arranged in a prescribed pattern, in accordance with the method of the first embodiment as described above of the present invention for manufacturing the heat transfer member.

The heat transfer face 110 is a region having a prescribed irregularity, which is optimized to make heat transfer through contact of one surface of the heat transfer face 110 with a high temperature fluid and contact of the other surface thereof with a low temperature fluid. The above-mentioned irregularity is formed on the basis of the known pattern of irregularity, which is provide with a wave-formed cross section having an excellent heat transfer property and with grooves through which condensed water can be discharged rapidly. Description of the irregularity is omitted.

The flange portion 120 is composed of flat portions 121 having a prescribed width, which are disposed continuously along the periphery of a rectangular shape. The opposite flat portions 121 of the flange portion 120, which are in parallel with feeding direction of the material to be worked, have a plurality of projections 122. These projections 122 extend form the outer edge over the flat portions 121 to lead to the heat transfer face 110. The projections 122 on the upper flat portion 121 are aligned with the projections 122 on the lower flat portion 121 in a perpendicular direction to the feeding direction of the material to be worked 100.

The press-forming device 1 used to manufacture the heat transfer member 200 includes the pair of main molds 10 for forming the heat transfer face, the two pairs of first auxiliary molds 20, 30 and the two pairs of second auxiliary molds 40, 50, as in the first embodiment of the present invention. The two pairs of first auxiliary molds 20, 30 and the two pairs of second auxiliary molds 40, 50 are disposed in the peripheral zone of the pair of main molds 10. The edge portions of the material to be worked, which is made of a metallic sheet, is subjected to the press forming utilizing the pairs of auxiliary molds 20, 30, 40, 50 to form the flange portion 120. The heat transfer face 110 is formed with the use of the pair of main molds 10.

Now, description will be given below of the heat transfer member as manufactured of the second embodiment of the present invention. The press-forming steps are applied to the metallic sheet serving as the material to be worked, utilizing the press-forming device 1 in accordance with the method of the first embodiment of the present invention for manufacturing the heat transfer member. The heat transfer member 200, which has been discharged from the press-forming device 1, is placed on the other transfer member 200 as manufactured in the same manner so that the inner surfaces of them face each other and the latter is positioned upside down. These heat transfer members 200 are welded together into a united body serving as a set of heat exchanger unit 300. An essential component of a heat exchanger is composed of a plural set of heat exchanger units 300 thus obtained.

The heat transfer member 200 has the flange portion 120, which is composed of the flat portions 121 having the prescribed width on the respective sides of the rectangular shape. The opposite upper and lower flat portions of the flange portion 120 have a plurality of projections 121. When the two heat transfer members 200 are placed one upon another in the same manner as described above, the flat portions 121 of the one heat transfer member 200 comes into close contact with the flat portions 121 of the other heat transfer member 200 so as to form an internal cavity, which is surrounded by the flange portions and the respective heat transfer faces 110. The corresponding two projections 122 formed on the flat portions 121 form a passage 130 communicating with the internal cavity mentioned above.

The two heat transfer members 200 are assembled into the heat exchanger unit 300 so that heat exchange fluid can flow in and out of the internal cavity through the passage 130 formed by the two projections 122. Flowing fluid to be heat-exchanged on the outer surface of the heat transfer member 200 provides a heat exchange operation. The position of the passage 130 can be set by determination of the position of the projection 122.

The flat portions 121 of the flange portion 120 serve as the portions to be welded when the heat transfer members 200 are finally welded into the heat exchanger unit 300, thus ensuring a reliable connection of the heat transfer members 200.

According to the heat transfer member of the second embodiment of the present invention, the flange portion 120 has the flat portions 121 and the projections 122. When the heat transfer member 200 is placed on the other heat transfer member 200 so that the inner surfaces of them face each other, the flat portions 121 of the former come into close contact with the flat portions 121 of the latter not only to form the internal cavity, which is surrounded by the flange portions 120 and the respective heat transfer faces 110, but also to form the passage 130 formed by the projections 122, which communicates with the internal cavity. The inlet and outlet of the heat exchanger unit as assembled can easily be set by determination of the position of the projection 122. It is possible to provide various kinds of flow of the heat exchange fluid in the heat exchanger unit 300, such as parallel flow or counter flow between fluids flowing inside and outside of the heat exchanger unit 300, thus coping with various conditions of use. When the heat transfer members 200 as press-formed are finally welded together, the flat portions 121 serve as the portions to be welded, thus facilitating the welding operation.

Figure 6:
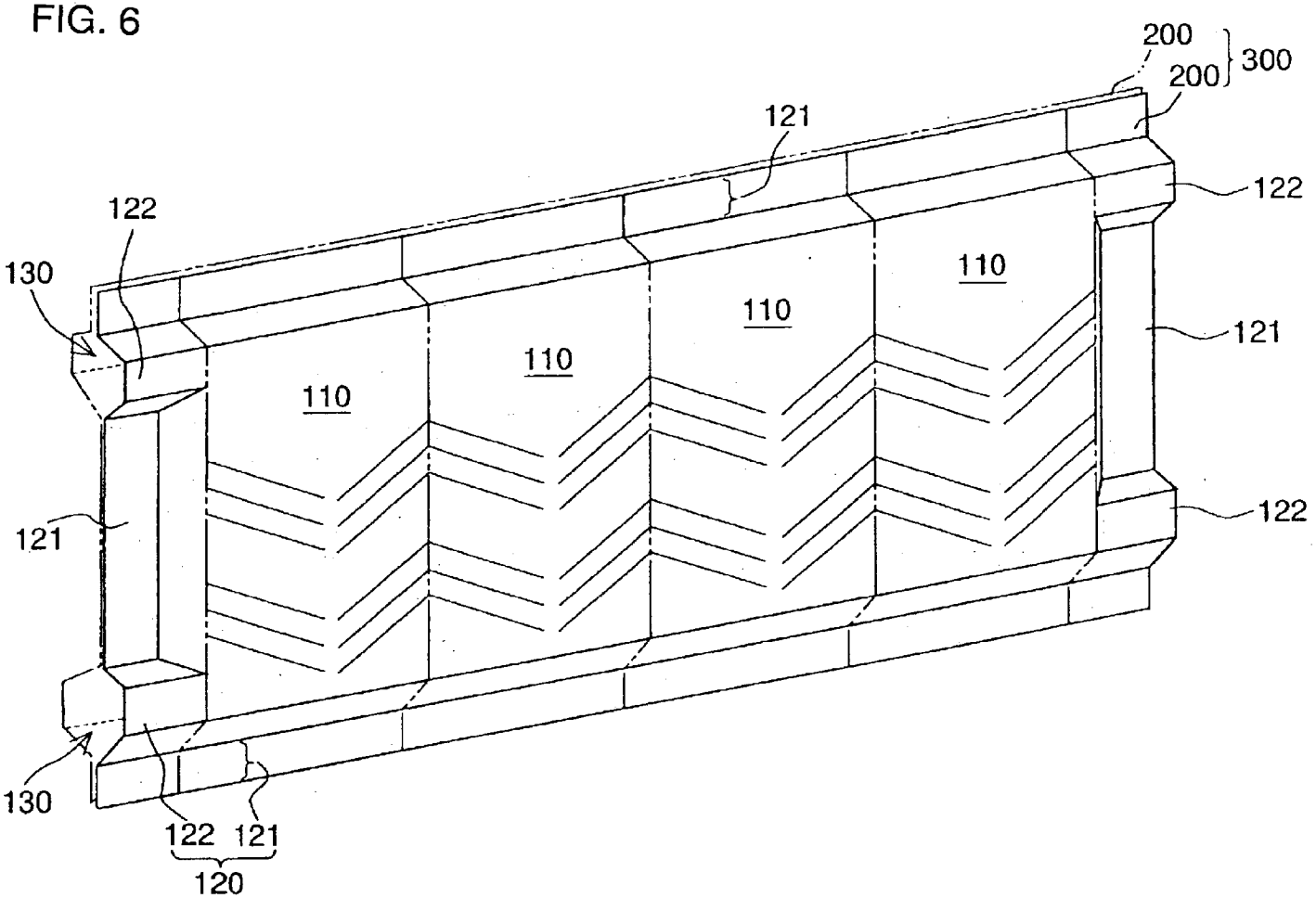
FIG. 6 is a schematic perspective view of the other heat transfer member of the second embodiment of the present invention.

In the heat transfer member of the second embodiment of the present invention, the flange portion 120 has the passages 130, which are disposed on the upper and lower horizontal sides of the assembled heat exchanger unit as shown in FIG. 5. The present invention is not limited only to such a structure and the passages 130 may be disposed on the right and left-hand vertical sides of the assembled heat exchanger as shown in FIG. 6, unlike the embodiment as shown in FIG. 5. Such a structure permits to provide various kinds of flow of the heat exchange fluid, for example a cross-flow between fluids flowing inside and outside of the heat exchanger unit 300, thus coping with various conditions of use.

[Third Embodiment of the Present Invention]

Figure 7:
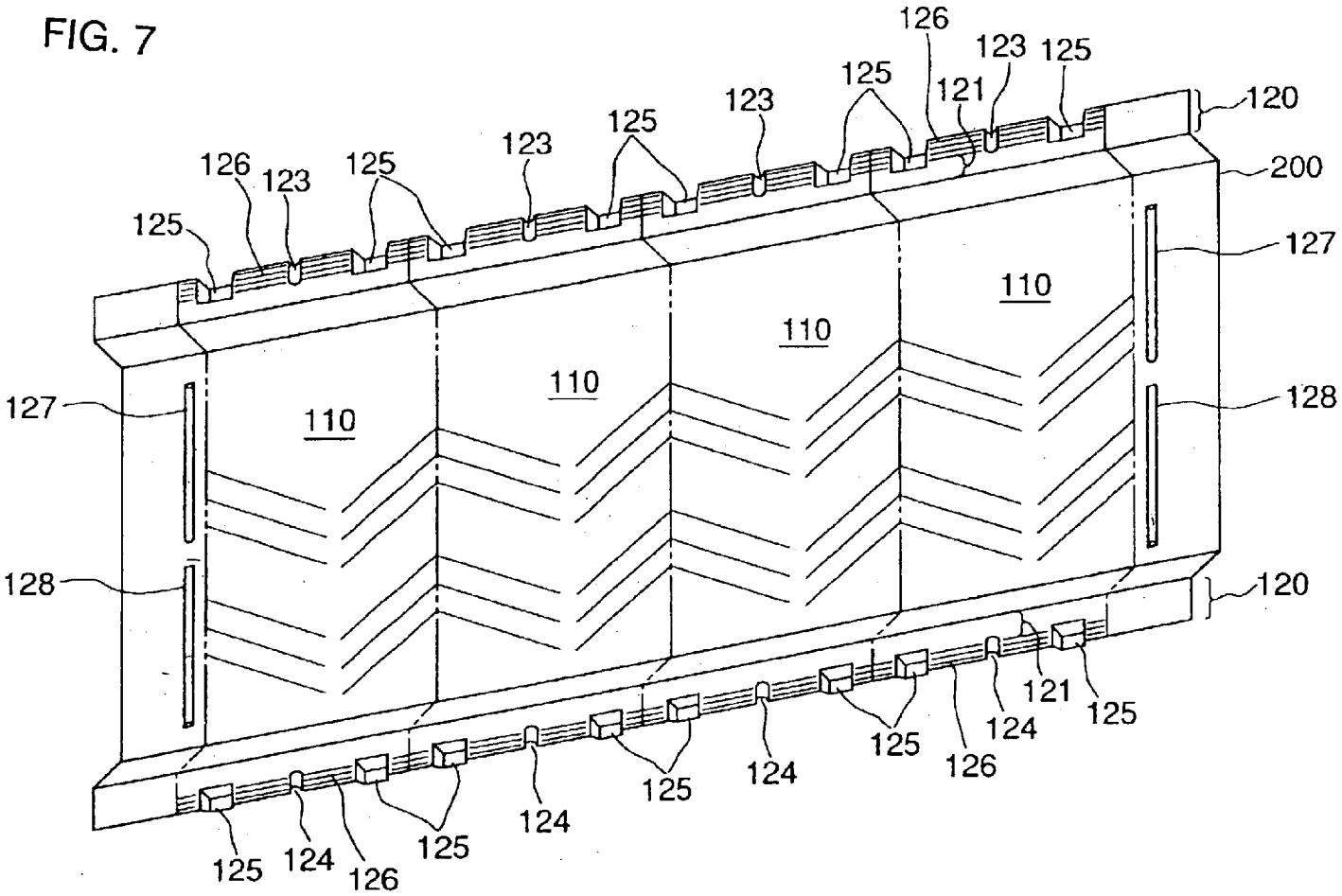
FIG. 7 is a schematic perspective view of the heat transfer member of the third embodiment of the present invention.
Figure 8A:
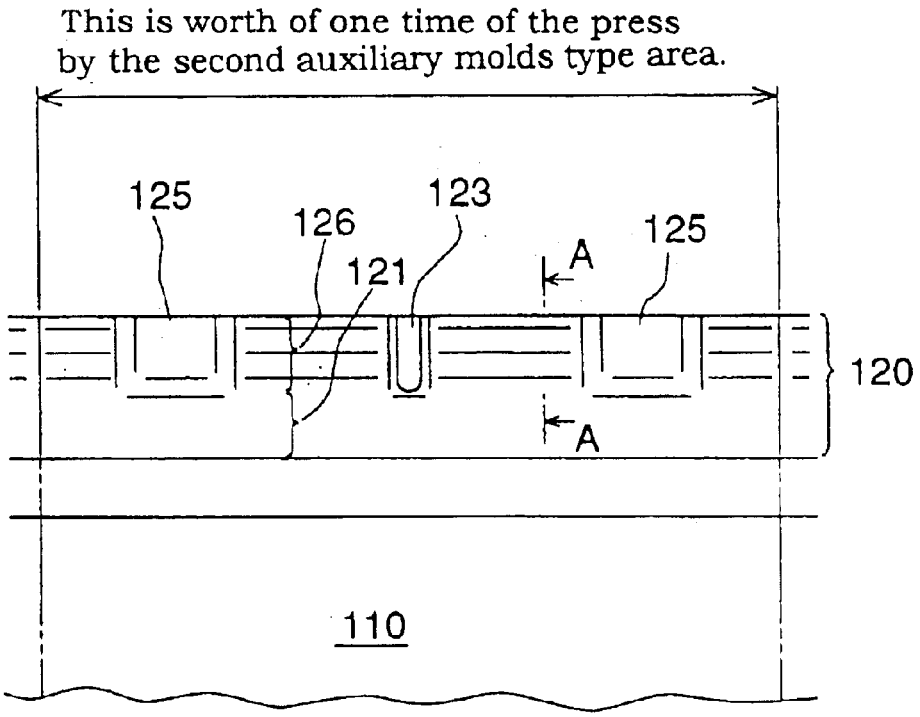
FIG. 8(A) is a partial front view of the heat transfer member of the third embodiment of the present invention and FIG. 8(B) is a plan view thereof.
Figure 8B:
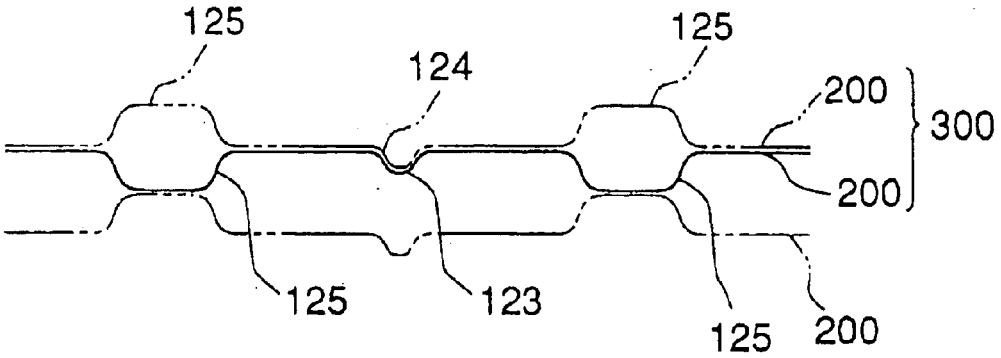
Figure 9:
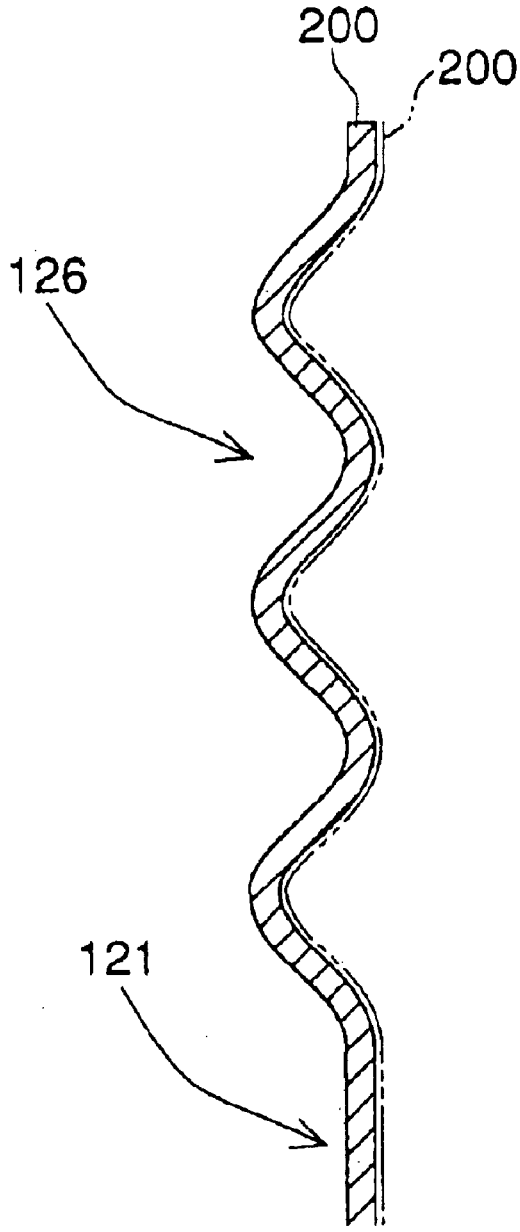
FIG. 9 is a cross-sectional view cut along the line A—A in FIG. 8(A)

Now, the third embodiment of the present invention will be described in detail below with reference to FIGS. 7 to 9. With respect to the third embodiment of the present invention, there is described the heat transfer member, which is manufactured in accordance with the method of the present invention for manufacturing the heat transfer member. FIG. 7 is a schematic perspective view of the heat transfer member of the third embodiment of the present invention, FIG. 8(A) is a partial front view of the heat transfer member of the third embodiment of the present invention and FIG. 8(B) is a plan view thereof and FIG. 9 is a cross-sectional view cut along the line A—A in FIG. 8(A).

The heat transfer member 200 of the third embodiment of the present invention is obtained by subjecting the material to be worked, which is made of the same metallic thin sheet as in the second embodiment of the present invention, to a press forming utilizing a press-forming device 1 to form the heat transfer face 110 and the flange portion 120 in accordance with the method of the first embodiment of the present invention for manufacturing the heat transfer member. The third embodiment differs from the second embodiment in that (i) recesses or projections are formed in the central position in an area on the opposite sides of the flange portion 120, which is subjected to the single press-forming step utilizing the pairs of second auxiliary molds 40, 50, on one hand, and symmetrical positions with respect to the central position, on an other hand, and (ii) grooved portions and projection portions are formed between the recesses or projections on the opposite sides of the flange portion so as to be in parallel with the opposite sides, thus forming a plurality of rows of irregularity having a smooth wave-shaped cross section.

Of the opposite sides of the flange portion 120, which are in parallel with the feeding direction of the material into the press-forming device 1, the upper side of the flange portion 120 has the projection 123 opening upward, which is disposed in the central position in the area, which is subjected to the single press-forming step utilizing the pairs of second auxiliary molds 40, 50. The lower side of the flange portion 120 has the recess 124 opening downward. The shape of the projection 123 is symmetrical to that of the recess 124 with respect to a plane including the flange portion 120. Additional projections 125, which project in the same direction as the above-mentioned projection 123, are formed in symmetrical positions of the opposite sides mentioned above with respect to the central position.

The other regions of the above-mentioned opposite sides of the flange portion 120 than the projections 123, the recesses 124 and the additional projections 125 have grooved portions and projection portions so as to be in parallel with the opposite sides, thus forming a plurality of rows of irregularity 126 having the smooth sine wave-shaped cross section. The shape of the irregularity on the upper side is symmetrical to that of the irregularity on the lower side with respect to the plane including the flange portion 120. Such a irregularity of the flange portion 120, having the wave-shaped cross section permits to improve the press-formability of the flange portion 120, thus reducing rate of occurrence of defects in products. The remaining areas of the flange portion 120 serve as the flat portions 121, which are identical to those in the second embodiment of the present invention.

The similar projections 127 and recesses 128 are also formed on the areas on the right and left-hand sides of the heat transfer faces 110, which are subjected to the press forming utilizing the pairs of first auxiliary molds 20, 30. The shape of the projection 127 is symmetrical to that of the recess 128 with respect to the plane including the flange portion 120.

Now, description will be given below of the heat transfer member as manufactured of the third embodiment of the present invention. The press-forming steps are applied to the metallic sheet serving as the material to be worked, utilizing the press-forming device 1 in accordance with the method of the first embodiment of the present invention for manufacturing the heat transfer member. The heat transfer member 200, which has been discharged from the press-forming device 1, is placed on the other transfer member 200 as manufactured in the same manner so that the inner surfaces of them face each other and the latter is positioned upside down. These heat transfer members 200 are welded together into a united body serving as a set of heat exchanger unit 300. An essential component of a heat exchanger is composed of a plural set of heat exchanger units 300 thus obtained.

The additional projections 125 formed on the opposite sides of the flange portion 120 serve as portions which are to be held to carry or transport the heat transfer member 200, thus permitting an easy and reliable transportation of the heat transfer member 200 without providing any adverse effects to the other portions of thereof.

The rows of irregularity 126 formed on the opposite sides of the flange portion 120 enhance the bending strength, thus preventing the flange portion 120 from being inappropriately bent. As a result, the flange portion 120 can be kept in a proper shape over its entirety even when the flange portion 120 is held to transport the heat transfer member 200.

The flange portion 120 of the heat transfer member 200 is provided on the opposite sides thereof with the projections 123, the recesses 124, the additional projections 125 and the rows of irregularity 126. When the heat transfer member 200 is placed on the other heat transfer member 200 so that the inner surfaces of them face each other and the latter is positioned upside down, the projection 123 of the one heat transfer member 200 engages with the corresponding recess 124 of the other heat transfer member 200, thus preventing the heat transfer members 200 from deviating from each other in the longitudinal direction. In addition, the rows of irregularity 126 and the flat portions 121 of the one heat transfer member 200 are placed on the corresponding rows of irregularity 126 and the corresponding flat portions 121 of the other heat transfer member 200, respectively, so as to be brought into contact with each other. In such a state, the above-mentioned engagement of the projection 123 with the corresponding recess 124 and the above-mentioned engagement of the rows of irregularity 126 with the corresponding rows of irregularity 126 prevent the heat transfer members 200 from deviating from each other in the longitudinal direction. Further, the additional projections 125 of the one heat transfer member 200 face the corresponding additional projections 125 of the other heat transfer member 200, respectively. As a result, there is formed the internal cavity, which is surrounded by the flange portions 120 and the heat transfer faces 110.

The flat portions 121 of the respective sides of the flange portion 120 serve as the portions to be welded, thus ensuring a reliable connection of the heat transfer members 200, when the heat transfer members 200 are finally welded together into the heat exchanger unit 300. In case where a plurality of heat exchanger units 300 as assembled are combined to form an essential component of a heat exchanger, the additional projections 125 of the one heat exchanger unit 300 come into contact with the additional projections 125 of the other heat exchanger unit 300 so that a prescribed gap is surely formed between the heat transfer face of the heat exchanger unit 300 and the heat transfer face of the adjacent heat exchanger unit 300 (see FIG. 8(B)).

In the above-mentioned case, the heat exchanger unit 300 is placed on the other heat exchanger unit 300 so that the outer surfaces of them face each other and the latter is positioned upside down. In such a state, the projections 127 and the recesses 128 of the one heat exchanger unit 300, which are disposed on the opposite sides in the feeding direction of the heat transfer member 200, face the recesses 128 and the projections 127 of the other heat exchanger unit 300, respectively, and the former components engage with the latter components so as to prevent the two heat exchanger units 300 from deviating from each other.

In the heat transfer member of the third embodiment of the present invention, the flange portion 120 is provided on its opposite sides with the rows of irregularity 126 having the grooved portions and the projection portions, which extend in parallel with the above-mentioned opposite sides, thus enhancing the bending strength of the opposite sides of the flange portion 120. As a result, the flange portion 120 can be kept in a proper shape over its entirety. Even when the flange portion 120 is held to transport the heat transfer member 200, it is possible to prevent the heat transfer member 200 from being deformed and insuring accuracy in shape. The flange portion 120 is provided on its opposite sides with the projection 123 and the recess 124 so that the shape of the projection 123 is symmetrical to that of the recess 124 with respect to a plane including the flange portion 120. When the heat transfer member 200 is placed on the other heat transfer member 200 so that the inner surfaces of them face each other and the latter is positioned upside down, the projection 123 of the one heat transfer member 200 engages with the corresponding recess 124 of the other heat transfer member 200, thus preventing the heat transfer members 200 from deviating from each other in the longitudinal direction. It is therefore possible to make a rapid positional determination when placing the heat transfer members 200 one upon another in order to prepare the heat exchanger unit. The heat transfer members 200, which have been placed one upon another, do not easily deviate from each other, even when they are transported. As a result, accuracy in the subsequent welding step can be enhanced.

In the heat transfer member of the third embodiment of the present invention, the additional projections 125 are formed in the two symmetrical positions of the opposite sides of the flange portion 120 with respect to the central position in the area, which is subjected to the single press-forming step utilizing the pairs of second auxiliary molds 40, 50. The additional projections 125 formed on the one side of the flange portion 120 project in the same direction as those formed on the opposite side thereof. When the heat transfer member 200 is placed on the other heat transfer member 200 so that the inner surfaces of them face each other and the latter is positioned upside down, the additional projections 125 of the one heat transfer member 200 face the corresponding additional projections 125 of the other heat transfer member 200, respectively. In case where a plurality of heat exchanger units 300 as assembled are combined to form an essential component of a heat exchanger, the additional projections 125 of the one heat exchanger unit 300 come into contact with the additional projections 125 of the other heat exchanger unit 300 so that a prescribed gap is surely formed between the heat transfer face of the heat exchanger unit 300 and the heat transfer face of the adjacent heat exchanger unit 300. As a result, a uniform heat exchanging property can be provided and strength of the heat exchange can be increased.

In the heat transfer member of the third embodiment of the present invention, the rows of irregularity 126 having the smooth wave-shaped cross section are formed on the opposite sides of the flange portion 120. The present invention is not limited only to such an embodiment and the rows of irregularity 126 may be formed on the other pair of opposite sides of the flange portion 120, or they may be formed on all the sides of the flange portion 120. Such rows of irregularity 126 impart a sufficient strength to the side of the flange portion 120, and lead to improvement in press-formability. The rows of irregularity 126 have the continuous sine wave-shaped cross-section. The present invention is not limited only to such an embodiment, and the rows of irregularity 126 may have the other smooth wave-shaped cross-section such as a saw tooth shape in which each tooth has a rectangular shape having small rounded corners or a triangular shape having a small rounded corner.

[Fourth Embodiment of the Present Invention]

Figure 10:
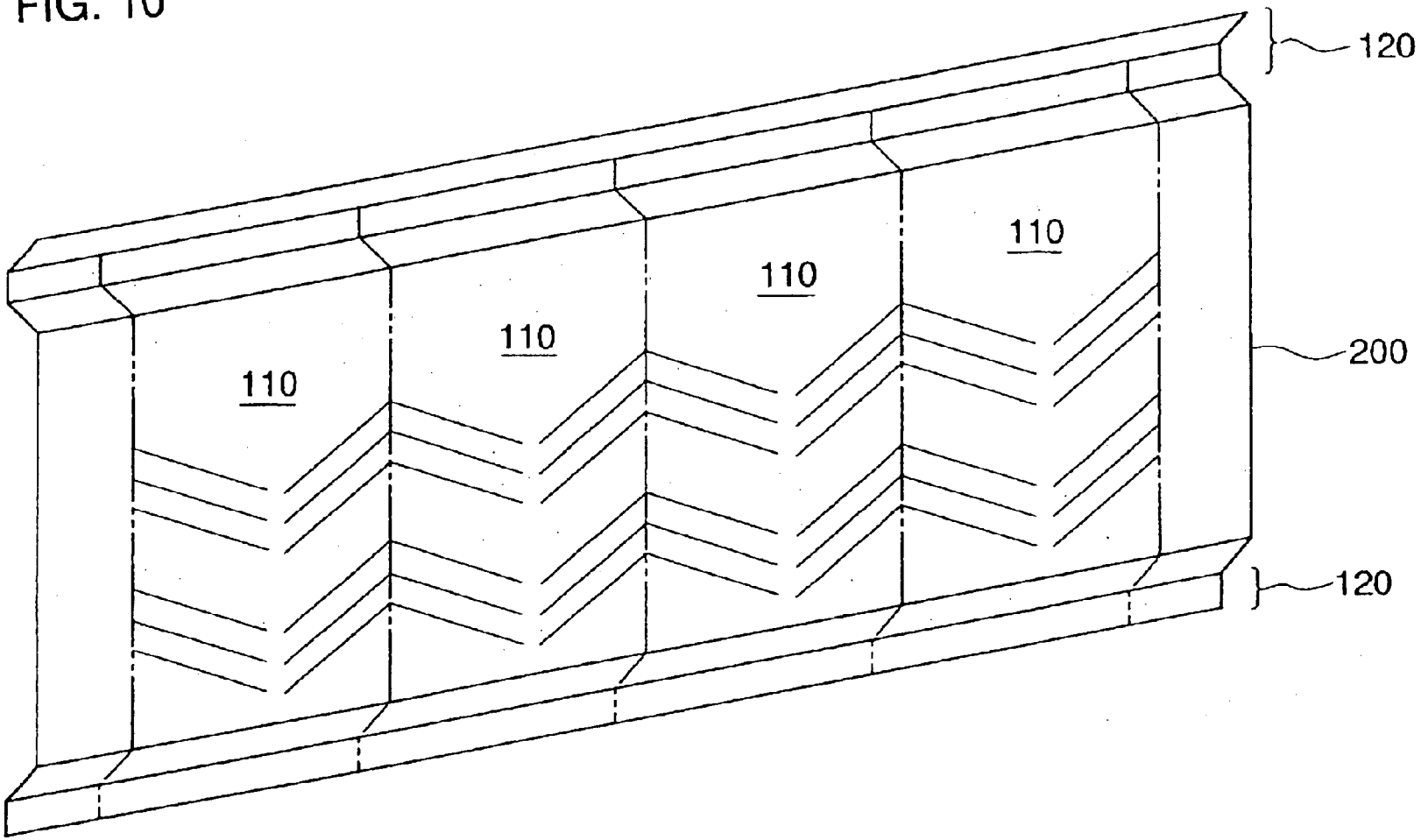
FIG. 10 is a schematic perspective view of the heat transfer member of the fourth embodiment of the present invention.
Figure 11:
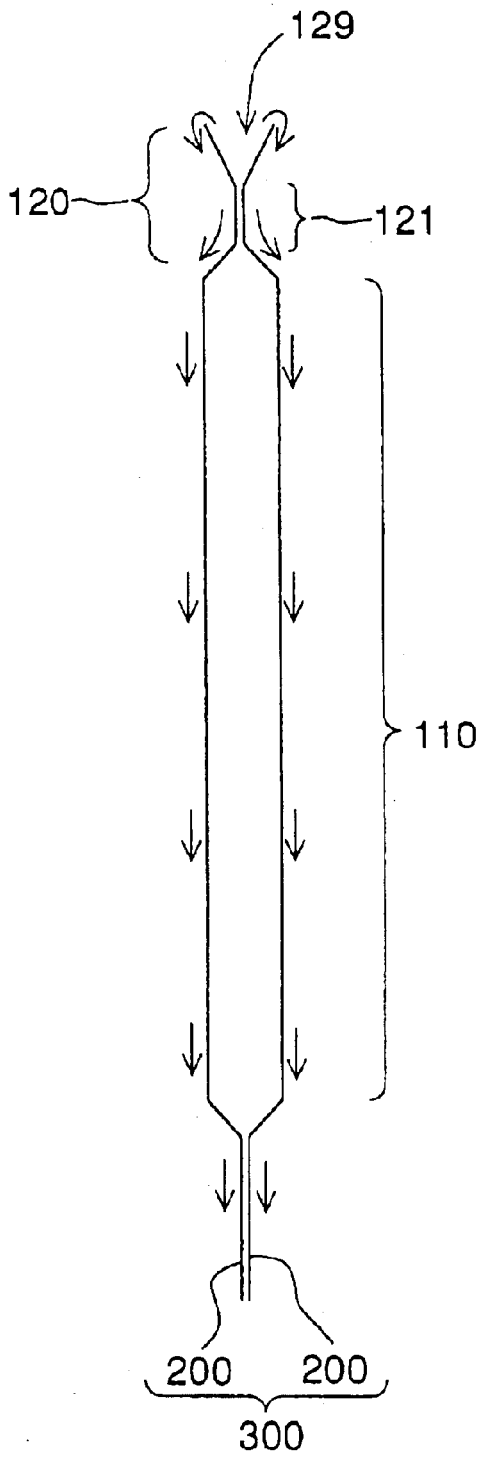
FIG. 11 is a descriptive view illustrating a state in which the heat transfer member of the fourth embodiment of the present invention is combined with the other heat transfer member of the same embodiment.
Figure 12:
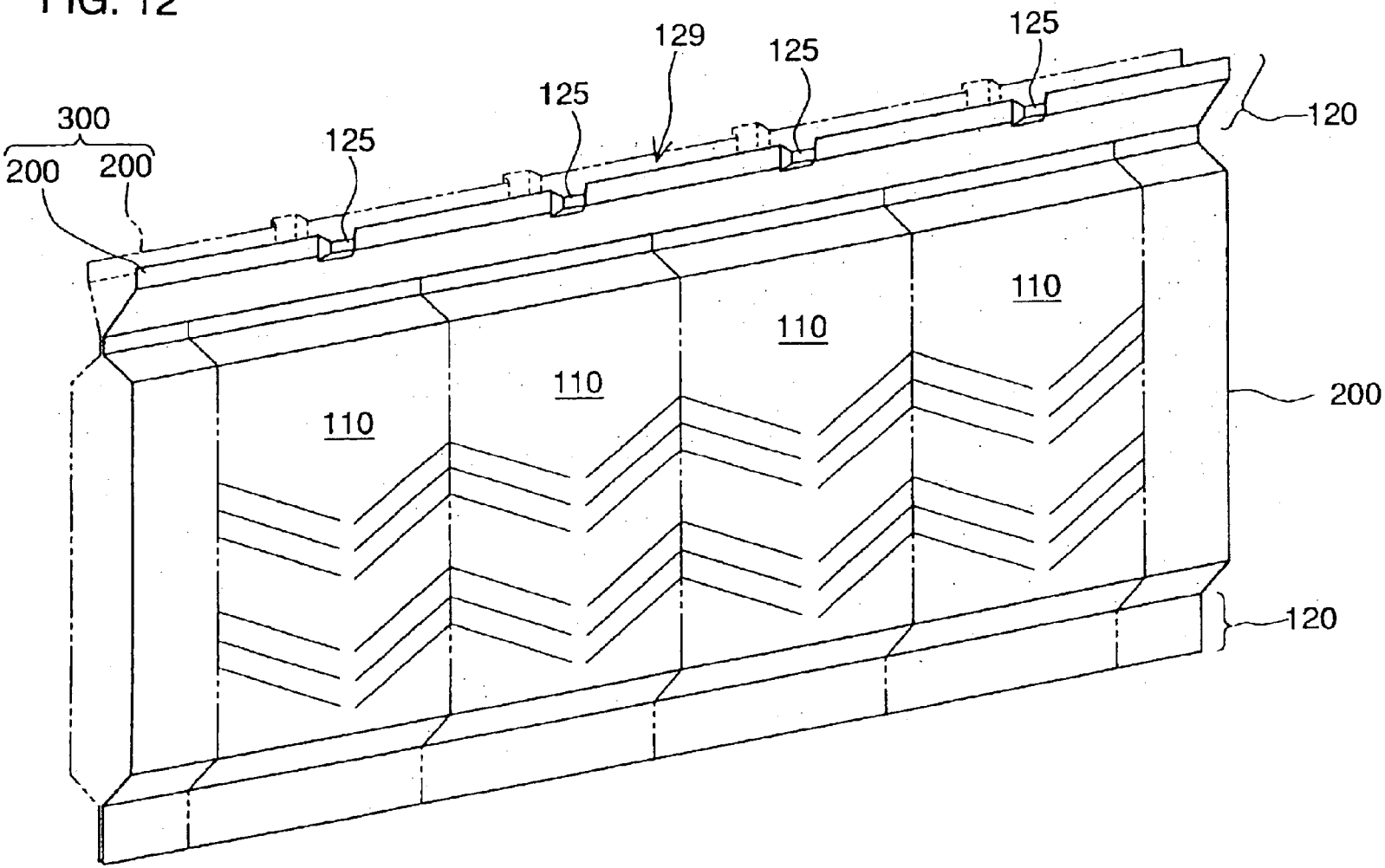
FIG. 12 is a schematic perspective view of the other heat transfer member of the fourth embodiment of the present invention.

Now, the fourth embodiment of the present invention will be described in detail below with reference to FIGS. 10 and 11. With respect to the fourth embodiment of the present invention, there is described the heat transfer member, which is manufactured in accordance with the method of the present invention for manufacturing the heat transfer member. FIG. 10 is a schematic perspective view of the heat transfer member of the fourth embodiment of the present invention and FIG. 11 is a descriptive view illustrating a state in which the heat transfer member of the fourth embodiment of the present invention is combined with the other heat transfer member of the same embodiment.

The heat transfer member 200 of the fourth embodiment of the present invention is obtained by subjecting the material to be worked, which is made of the same metallic thin sheet as in the second embodiment of the present invention, to a press forming utilizing a press-forming device 1 to form the heat transfer face 110 and the flange portion 120 in accordance with the method of the first embodiment of the present invention for manufacturing the heat transfer member. The fourth embodiment differs from the second embodiment in that the flange portion 120 has an inclined portion on the side, which is in parallel with the feeding direction of the material to be worked. The inclined portion, which extends from the upper edge of the flange portion 120 by a prescribed width, projects upward and inclines relative to the remaining portion of the flange portion 120 by a prescribed inclination angle.

The flange portion 120 has the flat portion 121 and the inclined portion. The flat portion 121, which has the prescribed width, extends in the longitudinal direction of the heat transfer member, i.e., the feeding direction of the material to be worked. The inclined portion continues from the upper longitudinal edge of the flat portion 121 so as to incline relative thereto by the prescribed inclination angle.

Now, description will be given below of the heat transfer member as manufactured of the third embodiment of the present invention. The press-forming steps are applied to the metallic sheet serving as the material to be worked, utilizing the press-forming device 1 in accordance with the method of the first embodiment of the present invention for manufacturing the heat transfer member. The heat transfer member 200, which has been discharged from the press-forming device 1, is placed on the other transfer member 200 as manufactured in the same manner so that the inner surfaces of them face each other. These heat transfer members 200 are welded together into a united body serving as a set of heat exchanger unit 300. An essential component of a heat exchanger is composed of a plural set of heat exchanger units 300 thus obtained.

The heat transfer member 200 is provided with the flange portion 120, which has the flat portion 121 having the prescribed width and the inclined portion continuing from the upper longitudinal edge of the flat portion 121 so as to incline relative thereto by the prescribed inclination angle. When the two heat transfer members 200 are placed on upon another, the flat portions of them come into close contact with each other so as to form an internal cavity, which is surrounded by the flange portions 120 and the heat transfer faces 110. The adjacent two inclined portions of the two heat transfer members 200 form a trough-shaped portion 129 above the heat transfer faces 110.

The two heat transfer members 200 are assembled into the heat exchanger unit 300 so that heat exchange fluid can flow in and out of the internal cavity. Flowing fluid to be heat-exchanged on the outer surface of the heat transfer member 200 provides a heat exchange operation. When liquid serving as heat exchange fluid, which is supplied into the trough-shaped portion 129, overflows, it flows down along the outer surfaces of the heat transfer face 110 (see FIG. 11). If the inside of the heat exchanger unit 300 serves as the low temperature side and the outside thereof serves as the high temperature side, the heat exchange fluid in liquid phase, which is overflowed from the trough-shaped portion 129, can be cooled during flowing down. If the heat exchanger unit is surrounded by the same heat exchange fluid in gaseous phase as that overflowed from the trough-shaped portion 129, it is possible to cool the heat exchange fluid in gaseous phase and causes the heat exchange fluid in liquid phase to absorb it, thus performing effective use of the heat exchanger as an absorber.

According to the heat transfer member of the fourth embodiment of the present invention, the flange portion 120 has the inclined portion on the side, which is in parallel with the feeding direction of the material to be worked. The inclined portion, which extends from the upper edge of the flange portion 120 by the prescribed width, projects upward and inclines relative to the remaining portion of the flange portion 120 by the prescribed inclination angle. When the heat transfer member 200 is placed on the other heat transfer member 200 so that the inner surfaces of them face each other and the inclined portions of them also face each other, the trough-shaped portion 129 is formed in a part of the flange portion 120 and the remaining portions of the two heat transfer members 200 come into close contact with each other. It is therefore possible to utilize the trough-shaped portion 129, which is located above the heat transfer faces, as a receiving portion for receiving the heat exchange fluid. More specifically, it is possible to provide a falling system for the heat exchange fluid on the outside of the heat exchanger unit 300, which has been assembled by the heat transfer members 200. Accordingly, the heat exchange conditions on the outer surface of the heat exchanger unit can be adapted to use of the heat exchanger, thus coping with various conditions of use.

In the heat transfer member of the fourth embodiment of the present invention, the inclined portion is formed as a part of the flange portion 120. The present invention is not limited only to such an embodiment and there may be provided a shoulder portion, which extends in the longitudinal direction from the upper longitudinal edge of the flange portion 120. In this case, when the heat transfer members are placed one upon another in the manner as described above, the similar trough-shaped portion is formed, thus making it possible to provide a falling system for the heat exchange fluid on the outside of the heat exchanger unit, which has been assembled by the heat transfer members 200.

In the heat transfer member of the fourth embodiment of the present invention, the inclined portion of the flange portion 120 is even on it entirety. The present invention is not limited only to such an embodiment and the inclined portion of the flange portion 120 may be provided with projections 125, which are formed at prescribed intervals in the longitudinal direction. In this case, when the two heat transfer members 200 are combined into the heat exchanger, the similar trough-shaped portion 129 is provided. In addition, in case where the assembled heat exchanger unit 300 is placed on the other assembled heat exchanger unit 300, the projections of the former heat exchanger unit comes into contact with those of the latter heat exchanger unit. Accordingly, the projections serves as a spacer for providing a space between the two adjacent heat exchanger units 300, thus maintaining a constant distance between the heat transfer faces and increasing strength of the trough-shaped portion 129. In addition, it is also possible to make a rapid positional determination utilizing the above-mentioned projections 125 when the heat transfer members 200 are placed one upon another during manufacture of the heat exchanger unit, thus leading to effective manufacture of the heat exchanger.

In the heat transfer member of the fourth embodiment of the present invention, the flange portion 120 excluding the projections 125 is even on its entirety. The present invention is not limited only to such an embodiment and the flange portion 120 may have grooved portions and projection portions so as to be in parallel with the opposite sides, thus forming a plurality of rows of irregularity having the smooth wave-shaped cross section in the same manner as the third embodiment of the present invention. Such a irregularity of the flange portion 120, having the wave-shaped cross section permits to improve the press-formability of the flange portion 120, thus reducing rate of occurrence of defects in products and increasing strength of the flange portion 120 to ensure the shape and functions of the trough-shaped portion 129.

In the heat transfer member of the fourth embodiment of the present invention, the flange portion 120 has the inclined portion on the upper side of the flange portion 120. The present invention is not limited only to such an embodiment and the flange portion 120 may have the inclined portions on the upper and lower sides of the flange portion 120. In this case, the flange portion 120 becomes symmetrical with respect to the heat transfer face 110. It is therefore possible to provide the heat exchanger unit 300 having the trough-shaped portion 129 even when the two heat transfer members 200 are placed one upon another so that the inner surfaces of them face each other and the latter is positioned upside down. There can be provided commonality of the heat transfer member 200, thus reducing the manufacturing cost.

According to the features of the first aspect of the present invention, the press forming is applied to the material to be worked with the use of the pair of main molds and the two pairs of first auxiliary molds, which are disposed in the feeding direction of the material to be worked. The plurality of different press-formed portions is formed on the material to be worked in the prescribed pattern so as to perform formation of the heat transfer member. The press-formed portions are further formed on prescribed regions of the heat transfer member. It is therefore possible to appropriately form a prescribed pattern of irregularity or prescribed flat portions on the outer peripheral portion of the material to be worked, independently from the heat transfer face, thus providing desired functions. The thus manufactured heat transfer member can cope with different conditions of use. In addition, the press-forming steps can be applied together to the material to be worked, utilizing the plurality of molds, thus improving the efficiency of the press forming. Even when the material to be worked is elongated and long, the appropriate press-forming steps can be carried out to form the heat transfer faces and the other portions over the entire length. As a result, it is possible to form the heat transfer face having a larger size than that of the molds in a reliable manner, thus permitting increase in size per unit of the heat transfer member so as to manufacture the heat exchanger having the enhanced heat exchange effectiveness.

According to the features of the second aspect of the present invention, the press-forming step can be applied simultaneously to the prescribed area starting from the one end of the material to be worked, with the use of combination of the pair of main molds and one of the two pairs of the first auxiliary molds or the combination of the pair of main molds and the other of the two pairs thereof, while keeping the remaining one of the two pairs of the first auxiliary molds in the non-contacting state with the material to be worked. The heat transfer face and the remaining press-formed portions can be formed simultaneously on the material to be worked, so as to be arranged in the prescribed pattern. It is therefore possible to form efficiently a plurality of the press-formed portions on the material to be worked at the minimum number of press-forming steps, thus remarkably improving the press-forming efficiency. When the press-forming step is carried out utilizing a certain pair of molds, the remaining pairs of molds are kept in the non-contacting state with the material to be worked, thus ensuring a desired shape of the heat transfer member.

According to the features of the third aspect of the present invention, the press forming is applied to the material to be worked, utilizing the pair of main molds and the pairs of second auxiliary molds, which are disposed in the perpendicular direction to the feeding direction, as an occasion demands, so that the prescribed press-formed portion is formed side by side with the heat transfer face on the material to be worked, with the use of the pair of second auxiliary molds, thus providing the prescribed press-formed portions on the respective edges of the material to be worked. It is therefore possible to achieve an appropriate formation of the prescribed press-formed portions on the respective edges of the material to be worked, independently from the heat transfer face, so as to impart the prescribed functions to the respective portions of the heat transfer member, thus providing the heat transfer member coping appropriately with the various conditions of use. When the press-forming step utilizing the pair of second auxiliary molds is not required, the pair of them is kept in the non-contacting state with the material to be worked, thus ensuring a desired shape of the heat transfer member.

According to the features of the fourth aspect of the present invention, the material to be worked, which is made of a metallic thin sheet, is press-formed utilizing the pair of main molds and the pair s of auxiliary molds of the press-forming device so as to form the different press-formed portions in a prescribed pattern so that the respective portions of the material to be worked are formed into the heat transfer face and the flange portion. Especially, the peripheral portions of the heat transfer member have the suitable shapes serving as the flange portion, which provide the different functions from those of the heat transfer face, thus coping with the various conditions of use. Even when the material to be worked is elongated and long, the appropriate press-forming steps can be carried out to form the heat transfer faces and the flange portion over the entire length. As a result, it is possible to form the heat transfer face having a larger size than that of the molds in a reliable manner, thus permitting increase in size per unit of the heat transfer member so as to manufacture the heat exchanger having the enhanced heat exchange effectiveness.

According to the features of the fifth aspect of the present invention, the heat transfer member is provided with the flat portions, which are disposed continuously in the peripheral direction of the heat transfer member so as to serve as the flange portion, and with the recess or projection. When the heat transfer member is placed on the other heat transfer member so that the inner surfaces of them face each other, the flat portions of the former come into contact with the flat portions of the latter to form an internal cavity, which is surrounded by the flange portions and the respective heat transfer faces. The recesses or projections of these heat transfer members form a passage, which communicates with the internal cavity. As a result, positional determination of the recesses or projections of the heat transfer members makes it possible to form the passage through which heat exchange fluid flows in the assembled heat exchanger unit. In addition, it is possible to provide various kinds of flow of the heat exchange fluid, such as a cross-flow type, in the entirety of the heat exchanger. In case where the heat transfer members, which have been press-formed, are finally welded together to form an assembled heat exchanger unit, the flat portions serve as the portion to be welded, thus facilitating the welding operation.

According to the features of the sixth aspect of the present invention, the opposing portions of the flange portion are provided at the prescribed position with the smooth wave-shaped cross section to form rows of irregularity, in which the recesses or projections continue in parallel with the opposing portions of the flange portion. Such a structure imparts a sufficient strength against the bending stress that is applied to the flange portion having the recesses or projections, thus enhancing the strength of the flange portion. Accordingly, it is possible to surely keep the entirety of the heat transfer member in a proper shape. It is also possible to hold the flange portion of the heat transfer member to transfer it during manufacturing steps, preventing the heat transfer member from being deformed and insuring accuracy in shape. Formation of irregularity having the wave-shaped cross section improves formability of the flange portion, thus reducing rate of occurrence of defects in products.

According to the features of the seventh aspect of the present invention, the flange portion has any one of the at least one recess and the at least one projection in at least one of central position between an area of the material to be worked, which is subjected to the single press-forming step utilizing the auxiliary molds and symmetrical positions with respect to the central position. The above-mentioned any one of the at least one recess and the at least one projection formed on one of the pair of opposite sides of the periphery of the material to be worked faces in the same direction as the other of them formed on the other of the pair of opposite sides thereof. When the heat transfer member is placed on the other heat transfer member so that the inner surfaces of them face each other and the latter is positioned upside down, the recess or projections of the former face those of the latter and the remaining portions of the flange portion come into close contact with each other. When the assembled heat exchanger unit is placed on the other assembled heat exchanger unit, the recess or projection of the former heat exchanger unit comes into contact with that of the latter heat exchanger unit. Accordingly, the recess or projection serves as a spacer for providing a space between the two adjacent heat exchanger units, thus maintaining a constant distance between the heat transfer faces, providing a uniform heat exchanging property and increasing strength of the heat exchanger. In addition, the recesses or projections face each other to form at least one passage on the side of the flange portion. The heat transfer member can be held at its passage portion to transfer it, thus making it possible to hold the transfer member in a proper manner and providing a safe transporting operation of the heat transfer member.

According to the features of the eighth aspect of the present invention, the flange portion has any one of the at least one recess and the at least one projection in at least one of a central position in an area of the material to be worked, which is subjected to the single press-forming step utilizing the auxiliary molds and symmetrical positions with respect to the central position. The above-mentioned any one of the at least one recess and the at least one projection formed on one of the pair of opposite sides of the periphery of the heat transfer face faces in the opposite direction to the other of them formed on the other of the pair of opposite sides thereof. When the heat transfer member is placed on the other heat transfer member so that the inner surfaces of them face each other and the latter is positioned upside down, the projection of the former heat transfer member is received into the recess of the latter heat transfer member to prevent deviation of these members. In addition, the remaining portions of the flange portion come into close contact with each other so that the recess or projection serves as a guide member by which positional determination for placing the heat transfer members one upon another. It is therefore possible to make a rapid positional determination when the heat transfer members are placed one upon another during manufacture of the heat exchanger unit. The heat transfer member, which has been placed on the other heat transfer member, may not deviate from the latter during a transporting operation of them, thus enhancing working precision in the subsequent step.

According to the features of the ninth aspect of the present invention, the flange portion formed in any one of the periphery of the material to be worked has any one of the shoulder portion having the prescribed width and the inclined portion, which extends from the peripheral edge by the prescribed length and is inclined from the remaining portion by the prescribed angle. When the heat transfer member is placed on the other heat transfer member so that the inner surfaces of them face each other and the shoulder portions or inclined portions face each other, a trough-shaped portion is formed on the flange portion. In addition, the remaining portions of the flange portion come into close contact with each other. It is therefore possible to direct the trough-shaped portion upward so as to serve as a receiving member for receiving the heat exchange fluid. As a result, there can be set appropriately a flow path for the heat exchange fluid in the heat exchanger unit into which the heat transfer members are assembled. Heat exchange conditions on the outer surface of the heat exchanger unit can be set in view of the use of the heat exchanger, thus coping with the various type of use.

What is claimed is:

1. A method for manufacturing a heat transfer member comprising the step of:

subjecting a material to be worked, which is made of a metallic thin sheet, to a press forming utilizing a press-forming device to form a heat transfer member for a heat exchanger, said heat transfer member having a prescribed shape, said heat transfer member having on at least one portion thereof a heat transfer face that has opposite surfaces, which are to come into contact with heat exchange fluids, respectively;

wherein:

said press-forming device comprises a pair of main molds for forming the heat transfer face on a prescribed portion of the material to be worked, which is to be conveyed in a single feeding direction, two pairs of first auxiliary molds, which are disposed on upstream and downstream sides of the pair of main molds in the feeding direction of the material to be worked, so as to be exchangeable, and two pairs of second auxiliary molds, which are disposed on opposite sides of said pair of main molds in a perpendicular direction to said feeding direction, so as to be exchangeable;

a plurality of portions of the material to be worked is subjected to the press forming utilizing at least one pair of said pair of main molds and said two pairs of first auxiliary molds to form the heat transfer member having a plurality of press-formed portions in a prescribed pattern; and said press forming device carries out applying simultaneously the press forming to the material to be worked within a prescribed area starting from one end thereof, with a use of said pair of main molds and one of said two pairs of first auxiliary molds, while keeping another of said two pairs of first auxiliary molds in a non-contacting state with the material to be worked.

2. The method as claimed in claim 1, wherein:

said press forming device carries out applying simultaneously the press forming to the material to be worked within a prescribed area starting from another end thereof, with a use of said pair of main molds and said other of said two pairs of first auxiliary molds, while keeping said one of said two pairs of first auxiliary molds in a non-contacting state with the material to be worked.

3. The method as claimed in claim 1 or 2, wherein:

each of said two pairs of second auxiliary molds is kept in any one of a state in which a press-forming operation utilizing the pair of second auxiliary molds is carried out in synchronization with a press-forming operation utilizing the pair of main molds and another state in which the pair of second auxiliary molds is kept in a non-contacting state with the material to be worked; and the heat transfer member is formed so that a press-formed portion formed by means of the pair of second auxiliary molds and the heat transfer face are arranged in at least one area.

4. A heat transfer member for a heat exchanger, which is obtained by subjecting a material to be worked, which is made of a metallic thin sheet, to a press forming utilizing a press-forming device, said heat transfer member having a prescribed shape, and said heat transfer member having on at least one portion thereof a heat transfer face that has opposite surfaces, which are to come into contact with heat exchange fluids, respectively, wherein:

said heat transfer member is formed by inserting the material to be worked into the press-forming device, which includes a pair of main molds for forming the heat transfer face and a plurality of pairs of auxiliary molds adjacent to a periphery of said pair of main molds, transferring the material to be worked in a single feeding direction, subjecting the material to be worked to a press forming utilizing the pair of main molds to form the heat transfer face at a central portion of the material to be worked and forming a flange portion having a prescribed shape on a periphery of the heat transfer face with a use of the plurality of pairs of auxiliary molds so that a plurality of press-formed portions are arranged in a prescribed pattern; and said flange portion has an inclined portion, which extends from a peripheral edge by a prescribed length and is inclined from a remaining portion by a prescribed angle.

5. The heat transfer member as claimed in claim 4, wherein:

said flange portion comprises a plurality of flat portions having a prescribed width, which are formed continuously on a periphery of the heat transfer face; and at least one recess or projection is formed so as to extend from an outer edge over said flat portion to lead to the heat transfer face.

6. The heat transfer member as claimed in claim 4, wherein:

the material to be worked is formed of the metallic thin sheet having a rectangular shape; and said flange portion is formed on each of at least a pair of apposite sides of the periphery of the heat transfer face, said flange portion on one of the pair of opposite sides being provided with grooved portions, which are formed continuously in a direction parallel to the opposite sides so as to provide a smooth wave-shape cross section, and said flange portion on another of the pair of opposite sides being provided with projection portions, which are formed continuously in a direction parallel to the opposite sides so as to provide a smooth wave-shape cross section.

7. The heat transfer member as claimed in any one of claims 4 to 6, wherein:

the material to be worked is formed of the metallic thin sheet having a rectangular shape; and each of at least a pair of opposite sides of said flange portion is provided with any one of at least one recess and at least one projection in at least one of a central position in an area, which is subjected to a single press-forming step utilizing said auxiliary molds, on one hand, and symmetrical positions with respect to said central position, on another hand, said at least one recess and said at least one projection facing in a same direction.

8. The heat transfer member as claimed in any one of claims 4 to 6, wherein:

the material to be worked is formed of the metallic thin sheet having a rectangular shape; and each of at least a pair of opposite sides of said flange portion is provided with any one of at least one recess and at least one projection in at least one of a central position in an area, which is subjected to a single press-forming step utilizing said auxiliary molds, on one hand, and symmetrical positions with respect to said central position, on another hand, said at least one recess and said at least one projection facing in an opposite direction to each other.

9. The heat transfer member as claimed in claim 4, wherein:

the material to be worked is formed of the metallic thin sheet having a rectangular shape; and said flange portion has a shoulder portion having a prescribed width.

* * * * *

UNITED STATES PATENT AND TRADEMARK OFFICE

CERTIFICATE OF CORRECTION

PATENT NO. : 6,793,014 B2
DATED : September 21, 2004
INVENTOR(S) : Toyoaki Matsuzaki et al.

It is certified that error appears in the above-identified patent and that said Letters Patent is hereby corrected as shown below:

Column 25,
Line 2, “apposite” should read -- opposite --.

Signed and Sealed this

First Day of February, 2005

JON W. DUDAS
*Director of the United States Patent and Trademark Office*